US010877431B1

(12) United States Patent
Kodo

(10) Patent No.: US 10,877,431 B1
(45) Date of Patent: Dec. 29, 2020

(54) IMAGE FORMING APPARATUS

(71) Applicant: TOSHIBA TEC KABUSHIKI KAISHA, Tokyo (JP)

(72) Inventor: Masahiro Kodo, Izunokuni Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/822,798

(22) Filed: Mar. 18, 2020

(51) Int. Cl.
*G03G 21/16* (2006.01)
*G03G 15/04* (2006.01)

(52) U.S. Cl.
CPC ... *G03G 21/1671* (2013.01); *G03G 15/04054* (2013.01); *G03G 15/04081* (2013.01); *G03G 21/1652* (2013.01); *G03G 21/1666* (2013.01); *G03G 2215/0409* (2013.01)

(58) Field of Classification Search
CPC ..... G03G 15/04054; G03G 21/1666; G03G 21/1671; G03G 2215/0409
See application file for complete search history.

(56) References Cited

U.S. PATENT DOCUMENTS 8,170,447 B2 * 5/2012 Kubo ..... G03G 15/0813 399/118
9,283,788 B2 * 3/2016 Shimamoto ..... G03G 15/04045
2009/0322851 A1 12/2009 Yokoi et al.
2014/0320834 A1 10/2014 Mikami et al.
2018/0364614 A1 12/2018 Aruga et al.

FOREIGN PATENT DOCUMENTS

JP 2008-143010 A 6/2008
JP 2018-030284 A 3/2018

* cited by examiner

*Primary Examiner* — Erika J Villaluna
(74) *Attorney, Agent, or Firm* — Foley & Lardner LLP

(57) ABSTRACT

An image forming apparatus includes a photoconductive body, a light source, a lens, a light housing, a first fulcrum, a second fulcrum, a stay, and a repositioning mechanism. The lens is positioned to focus light emitted from the light source at a focal position. The light housing holds the light source and the lens. The fulcrums are positioned such that a surface of the photoconductive body is positioned at the focal position when the light housing engages the first fulcrum and the second fulcrum. The stay is positioned to support the light housing at two or more points between the fulcrums. The repositioning mechanism is coupled to the stay. The light housing presses against the fulcrums when the repositioning mechanism is in a first configuration and is spaced from the fulcrums when the repositioning mechanism is in a second configuration.

13 Claims, 14 Drawing Sheets

IMAGE FORMING APPARATUS

FIELD

Embodiments described herein relate generally to an image forming apparatus.

BACKGROUND

A line-type light source such as a light emitting diode (LED) array may be used as an exposure light source of an image forming apparatus. The line-type light source is held by a highly rigid holding member together with a lens and a circuit board. The holding member is movably supported by a moving mechanism in order to adjust the focusing position of the lens to the surface of a photoconductive body.

For example, the holding member may be connected to a stay that is long in the longitudinal direction of the holding member and moves forward and backward with respect to the photoconductive body.

Depending on the force acting on the stay in the moving mechanism, the stay may warp and deform, and the gap between the holding member and the photoconductive body may be narrowed.

DETAILED DESCRIPTION

Figure 1:
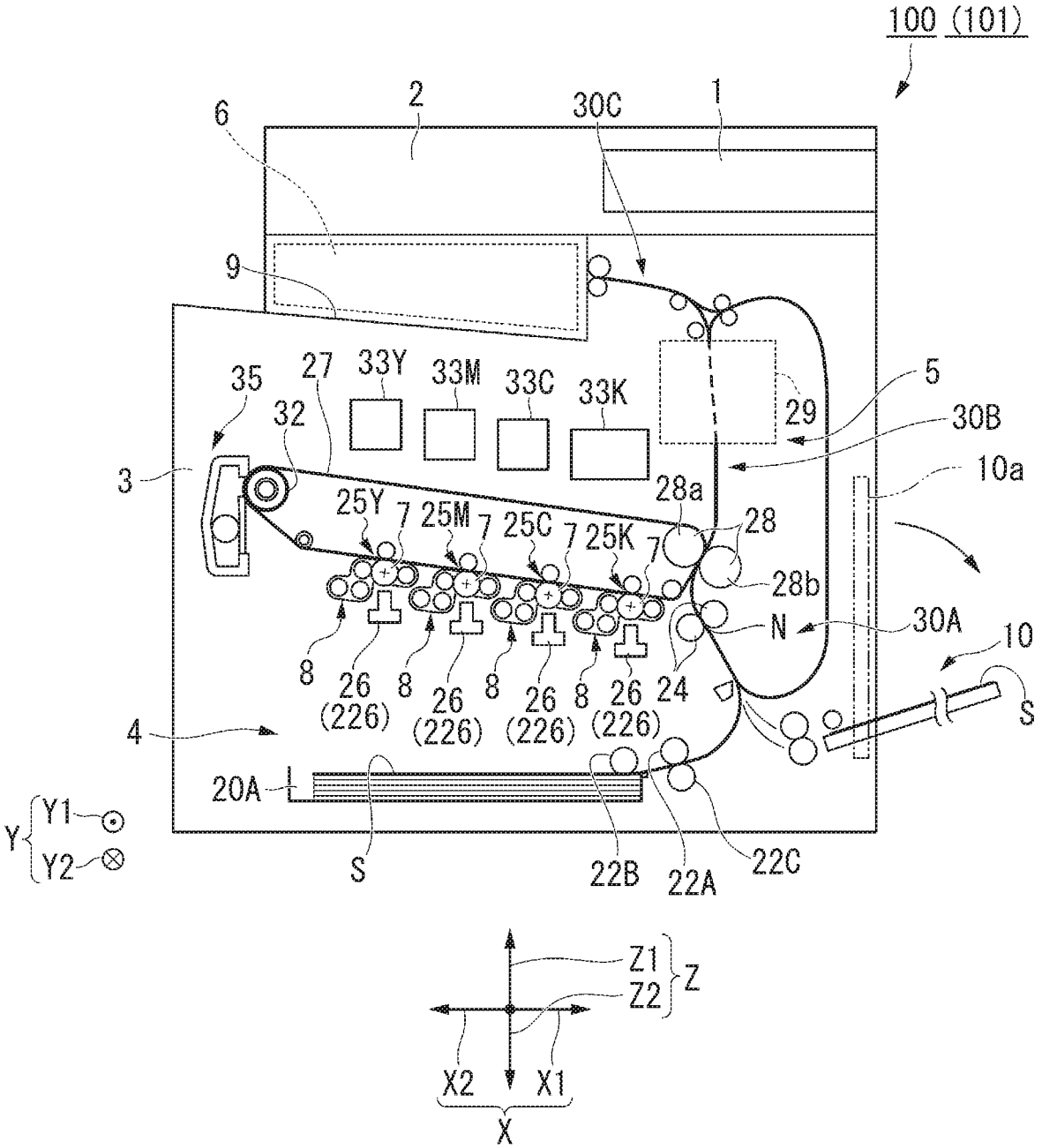
FIG. 1 is a schematic cross-sectional view illustrating a configuration example of an image forming apparatus according to a first embodiment.

According to one embodiment, an image forming apparatus includes a photoconductive body, a light source, a lens, a holding member, two fulcrums, a stay, and a mechanism. The photoconductive body carries an electrostatic latent image. A plurality of light emitting elements are arranged in the light source in a first direction. The lens directs or focuses light from the plurality of light emitting elements at a focal position, so as to condense the light. The holding member holds the light source and the lens. The two fulcrums are arranged in the first direction and abut the holding member. The two fulcrums position the holding member at a position where the focal position matches the surface of the photoconductive body. The stay supports the holding member at two points arranged between the two fulcrums in the first direction and arranged in the first direction. The stay includes an operating point between the two points in the first direction. The mechanism moves the holding member together with the stay in a second direction with respect to the two fulcrums by applying a force in the second direction to the operating point. The second direction is a direction different from the first direction, and a direction in which the holding member is pressed against and abuts the two fulcrums.

Hereinafter, the image forming apparatus of the embodiment will be described with reference to drawings. In the following drawings, the same or corresponding components are denoted by the same reference numerals unless otherwise specified.

First Embodiment

FIG. 1 is a schematic cross-sectional view illustrating an example of the overall configuration of an image forming apparatus 100 according to a first embodiment. As illustrated in FIG. 1, the image forming apparatus 100 according to the present embodiment includes a control panel 1 (operator interface), a scanner unit 2 (scanner), a printer unit 3 (printer), a sheet feed unit 4 (sheet feeder, sheet tray), a conveyance unit 5 (conveyor), a manual feed unit 10 (manual feeder, manual feed tray), and a control unit 6 (controller). Hereinafter, when referring to a relative position in the image forming apparatus 100, X1, X2, Y1, Y2, Z1, and Z2 directions illustrated in the drawing may be used. The X1 direction is a direction from the left to the right when standing in front of the image forming apparatus 100 (front side of FIG. 1). The X2 direction (i.e., left) is a direction opposite to the X1 direction (i.e., right). The Y1 direction is a direction from the back to the front of the image forming apparatus 100. The Y2 direction is opposite to the Y1 direction (i.e., front to back). The Z1 direction is a vertically upward direction. The Z2 direction is a vertically downward direction. When the orientation in the X1(Y1, Z1) direction and the X2(Y2, Z2) direction does not matter or when both directions are included, the orientation is simply referred to as an X(Y, Z) direction. A plane having a normal line in an X direction is referred to as a YZ plane, a plane having a normal line in a Y direction is referred to as a ZX plane, and a plane having a normal line in a Z direction is referred to as an XY plane. The ZX plane is a plane parallel to a conveyance direction of the sheet S in the image forming apparatus 100. The XY plane is a horizontal plane.

The control panel 1 operates the image forming apparatus 100 when a user performs an operation. The scanner unit 2 reads image information from an object (e.g., sheet of paper) to be copied. The scanner unit 2 sends the read image information to the printer unit 3. The printer unit 3 forms an image on a sheet S based on the image information from the scanner unit 2 or data received from an external device (e.g., a computer, a laptop, a smartphone, etc.). The printer unit 3 forms an image (e.g., a toner image) by using a developer containing toner. The printer unit 3 transfers the toner image onto a surface of the sheet S. The printer unit 3 applies heat and pressure to the toner image on the surface of the sheet S to fix the toner image on the sheet S.

The sheet feed unit 4 feeds sheets S to the printer unit 3 one by one at the timing when the printer unit 3 forms a toner image. The sheet feed unit 4 includes a sheet feed cassette 20A and a cassette sheet feed unit. The sheet feed cassette 20A stores sheets S of various sizes. The cassette sheet feed unit is located above the end of the sheet feed cassette 20A in the X1 direction. The cassette sheet feed unit includes a pickup roller 22B, a sheet feed roller 22A, and a separation roller 22C.

The pickup roller 22B conveys the sheet S required for image formation from the sheet feed cassette 20A to a nip portion between the sheet feed roller 22A and the separation roller 22C. The sheet feed roller 22A conveys the sheet S conveyed to the nip portion to the conveyance unit 5. The separation roller 22C separates one sheet S from a plurality sheets S when a plurality of sheets S are conveyed by the pickup roller 22B.

The conveyance unit 5 includes a registration roller 24. The registration roller 24 aligns the leading end of the sheet S fed by the sheet feed roller 22A at a nip N. The registration roller 24 conveys the sheet S in accordance with the timing at which the printer unit 3 transfers the toner image onto the sheet S. The registration roller 24 conveys the sheet S toward a transfer unit 28.

The printer unit 3 includes image forming units 25Y, 25M, 25C, and 25K; an exposure unit 26; an intermediate transfer belt 27; a transfer unit 28; a fixing unit 29; and a transfer belt cleaning unit 35. The image forming units 25Y, 25M, 25C, and 25K are arranged in this order in the X1 direction. Each of the image forming units 25Y, 25M, 25C, and 25K forms a toner image on the intermediate transfer belt 27 to be transferred to the sheet S. The image forming units 25Y, 25M, 25C, and 25K each include a photoconductive body 7. The image forming units 25Y, 25M, 25C, and 25K form yellow, magenta, cyan, and black toner images, respectively, on the photoconductive bodies 7 associated therewith. According to the example embodiment shown, the photoconductive bodies 7 are drums or drum-shaped. In other embodiments, the photoconductive bodies 7 are belts or belt-shaped.

A charger, the exposure unit 26, a developing unit 8, a primary transfer roller, a cleaning unit, and a static eliminator are disposed around each photoconductive body 7. The primary transfer roller faces the photoconductive body 7. The intermediate transfer belt 27 is sandwiched between the primary transfer roller and the photoconductive body 7.

Above the image forming units 25Y, 25M, 25C, and 25K, toner cartridges 33Y, 33M, 33C, and 33K are disposed. The toner cartridges 33Y, 33M, 33C, and 33K contain yellow, magenta, cyan, and black toners, respectively. The toners of the toner cartridges 33Y, 33M, 33C, and 33K are supplied to the image forming units 25Y, 25M, 25C, and 25K by a toner supply pipe (not illustrated).

The exposure unit 26 irradiates (e.g., charges) a surface of each photoconductive body 7 with light. Light emission is controlled based on image information. The exposure unit 26 of the present embodiment includes a light source in which a plurality of light emitting elements (e.g., LEDs) are arranged in the Y1 direction. In the example illustrated in FIG. 1, the exposure unit 26 is disposed below the image forming units 25Y, 25M, 25C, and 25K, respectively. Each exposure unit 26 is supplied with image information corresponding to yellow, magenta, cyan, and black, respectively, included within an image. Each exposure unit 26 then forms an electrostatic latent image on the surface of each photoconductive body 7 based on image information.

The intermediate transfer belt 27 is an endless belt. Tension is applied to the intermediate transfer belt 27 by a plurality of rollers disposed along an inner peripheral surface thereof. The intermediate transfer belt 27 is stretched flat. The inner peripheral surface of the intermediate transfer belt 27 abuts a support roller 28*a* at the most distant position in the X1 direction in the stretching direction. The inner peripheral surface of the intermediate transfer belt 27 abuts a transfer belt roller 32 at the most distant position in the X2 direction in the stretching direction. The support roller 28*a* forms a part of the transfer unit 28. The support roller 28*a* guides the intermediate transfer belt 27 to a secondary transfer position. The transfer belt roller 32 guides the intermediate transfer belt 27 to a cleaning position.

On a lower surface side of the intermediate transfer belt 27 in the drawing, the image forming units 25Y, 25M, 25C, and 25K, excluding the primary transfer roller, are disposed in this order in the X1 direction. The image forming units 25Y, 25M, 25C, and 25K are disposed in a region between the transfer belt roller 32 and the support roller 28*a* with a space therebetween. A transfer bias is applied to the primary transfer rollers of the image forming units 25Y, 25M, 25C, and 25K when the toner image reaches a primary transfer position. Each primary transfer roller transfers the toner image on the surface of each photoconductive body 7 onto the intermediate transfer belt 27.

In the intermediate transfer belt 27, the transfer unit 28 is disposed at a position adjacent to the image forming unit 25K. The transfer unit 28 includes the support roller 28*a* and a secondary transfer roller 28*b*. The secondary transfer roller 28*b* and the support roller 28*a* sandwich the intermediate transfer belt 27. The position where the secondary transfer roller 28*b* and the intermediate hand transfer belt 27 abut with each other is the secondary transfer position. The transfer unit 28 transfers the charged toner image on the intermediate transfer belt 27 onto the surface of the sheet S at the secondary transfer position. The transfer unit 28 applies a transfer bias to the secondary transfer position. The transfer unit 28 transfers the toner image on the intermediate transfer belt 27 to the sheet S via the transfer bias.

The fixing unit 29 applies heat and pressure to the sheet S to thereby fixe the toner image transferred to the sheet S. The fixing unit 29 is disposed above the transfer unit 28.

The transfer belt cleaning unit 35 faces the transfer belt roller 32. The transfer belt cleaning unit 35 sandwiches the intermediate transfer belt 27. The transfer belt cleaning unit 35 scrapes off excess toner on the surface of the intermediate transfer belt 27 (e.g., after the toner image is fixed to the sheet S).

Conveyance path 30A conveys the sheet S between the registration roller 24 and the transfer unit 28, conveyance path 30B conveys the sheet S between the transfer unit 28 and the fixing unit 29, and conveyance path 30C conveys the sheet S from the fixing unit 29 to a dispensing tray 9. Each of the conveyance paths 30A, 30B, and 30C includes a conveyance guide portion and a conveyance roller that face each other with the sheet S interposed therebetween.

The manual feed unit 10 facilitates manually feeding the sheet S on which an image is formed to the printer unit 3.

When the manual feed unit 10 is used, the manual feed unit 10 is rotated clockwise from a storage position 10*a* to an feed positioned as illustrated by the arrow. Sheets S of various sizes can be placed on the opened manual feed unit 10. The manual feed unit 10 may include a similar pickup roller, paper feed roller, and separation roller as the sheet feed unit 4.

The control unit 6 controls various components of the image forming apparatus 100. For example, the control unit 6 controls the control panel 1, the scanner unit 2, the printer unit 3, the sheet feed unit 4, the conveyance unit 5, and the manual feed unit 10 to convey the sheet S through the printer unit 3 and form the image on the sheet S. The control unit 6 may be or include, for example, a processor such as a central processing unit (CPU).

Figure 2:
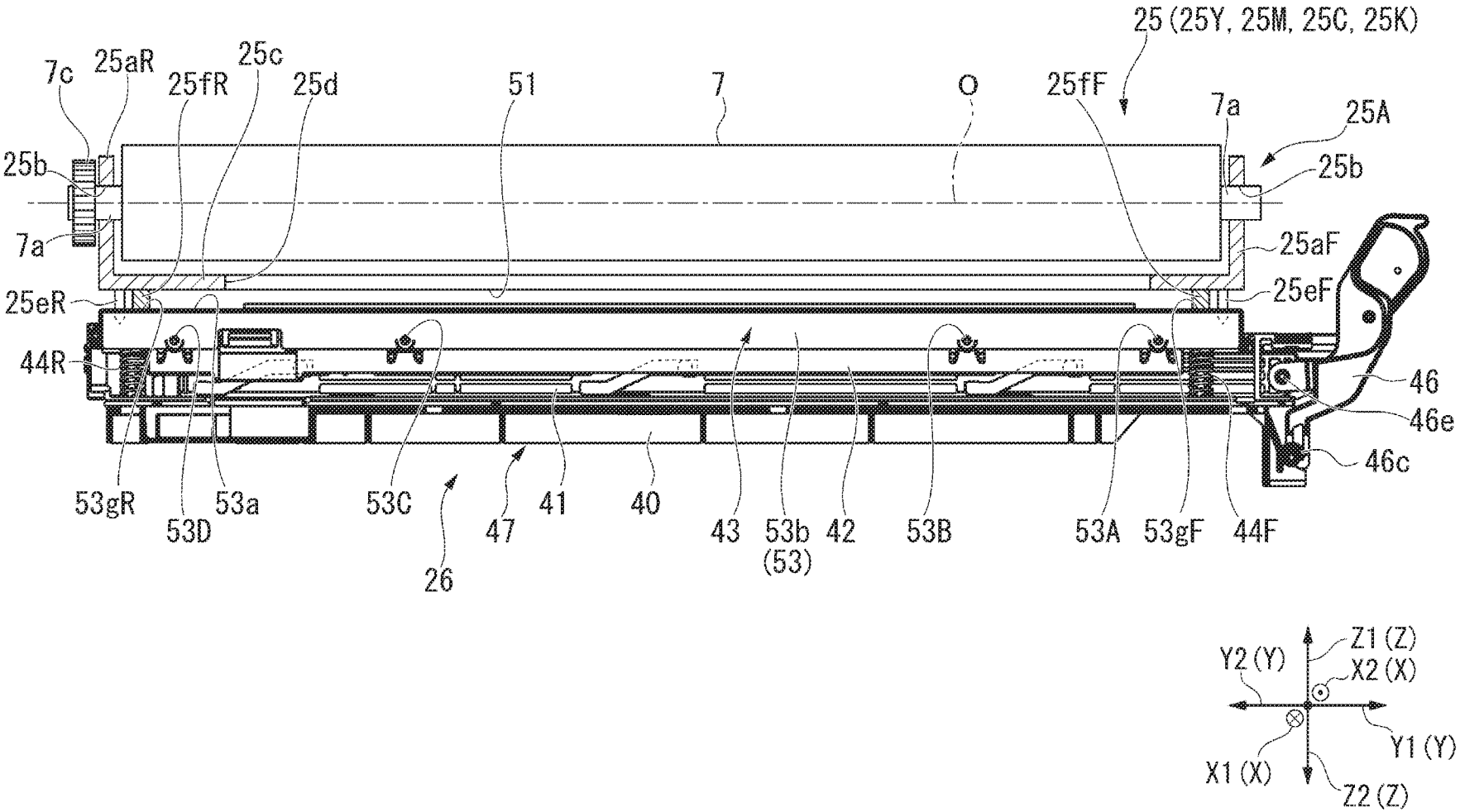
FIG. 2 is a schematic side view illustrating a photoconductive body, an exposure unit, and a mechanism in the image forming apparatus according to the first embodiment.
Figure 3:
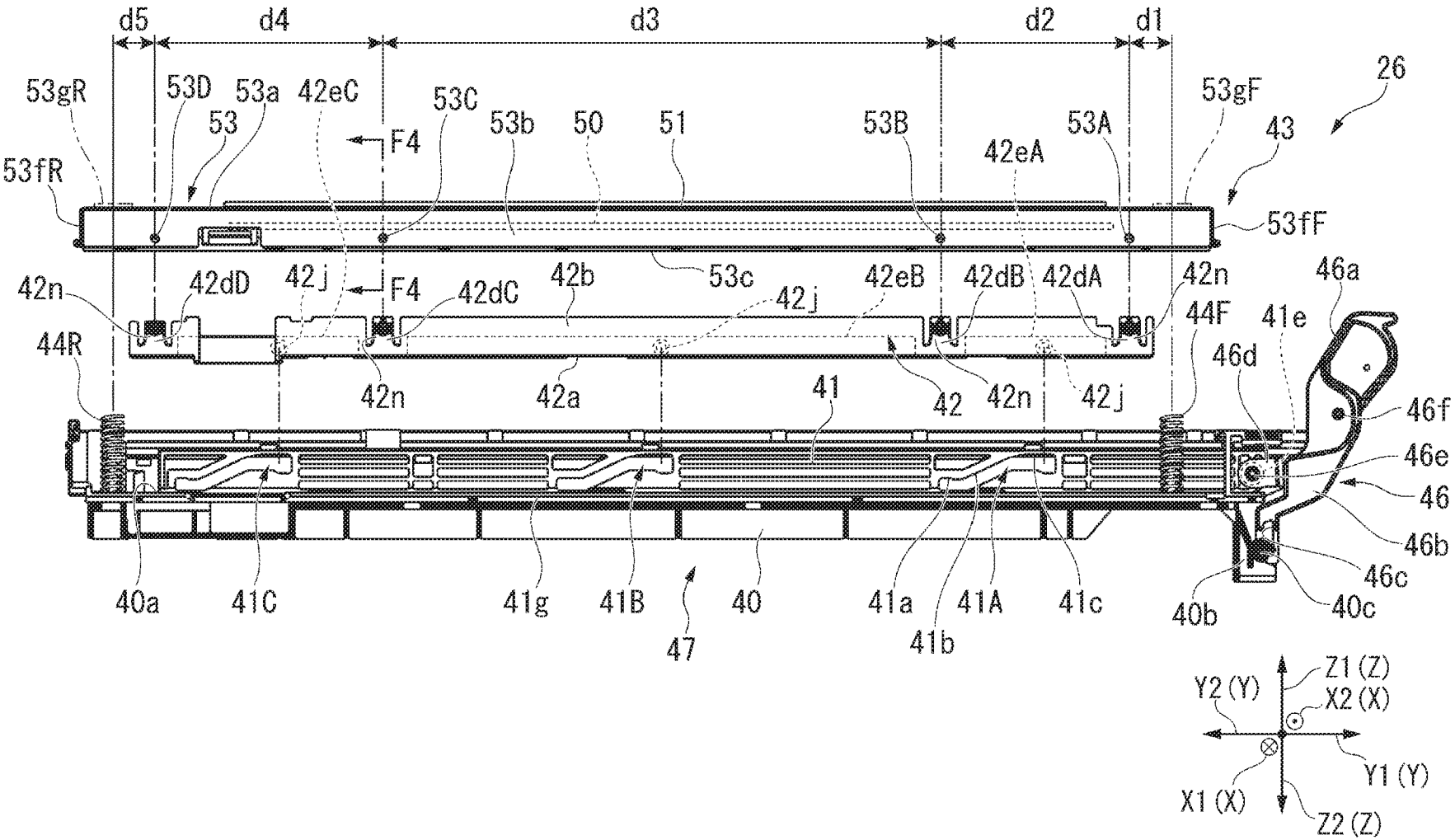
FIG. 3 is an exploded view of the exposure unit and the mechanism in the image forming apparatus according to the first embodiment.
Figure 4:
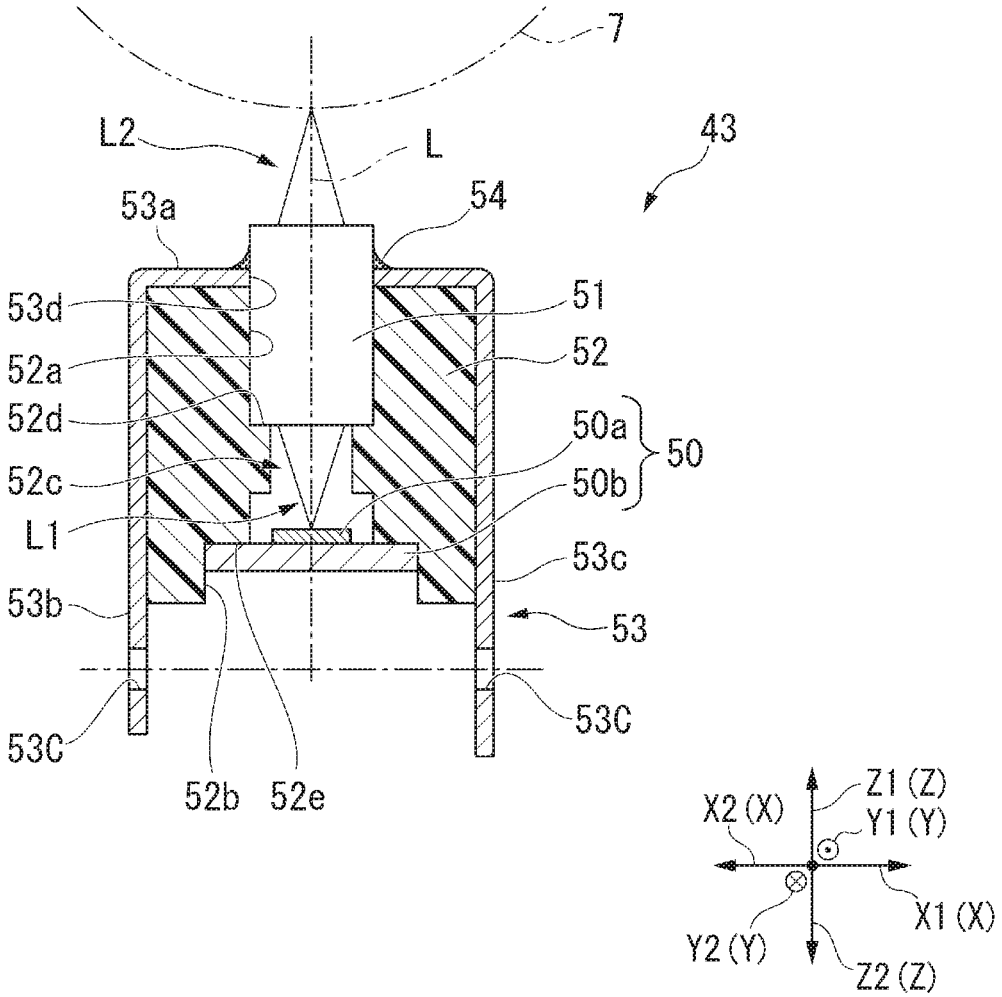
FIG. 4 is a schematic view of a cross section taken along the line F4-F4 in FIG. 3.
Figure 5:
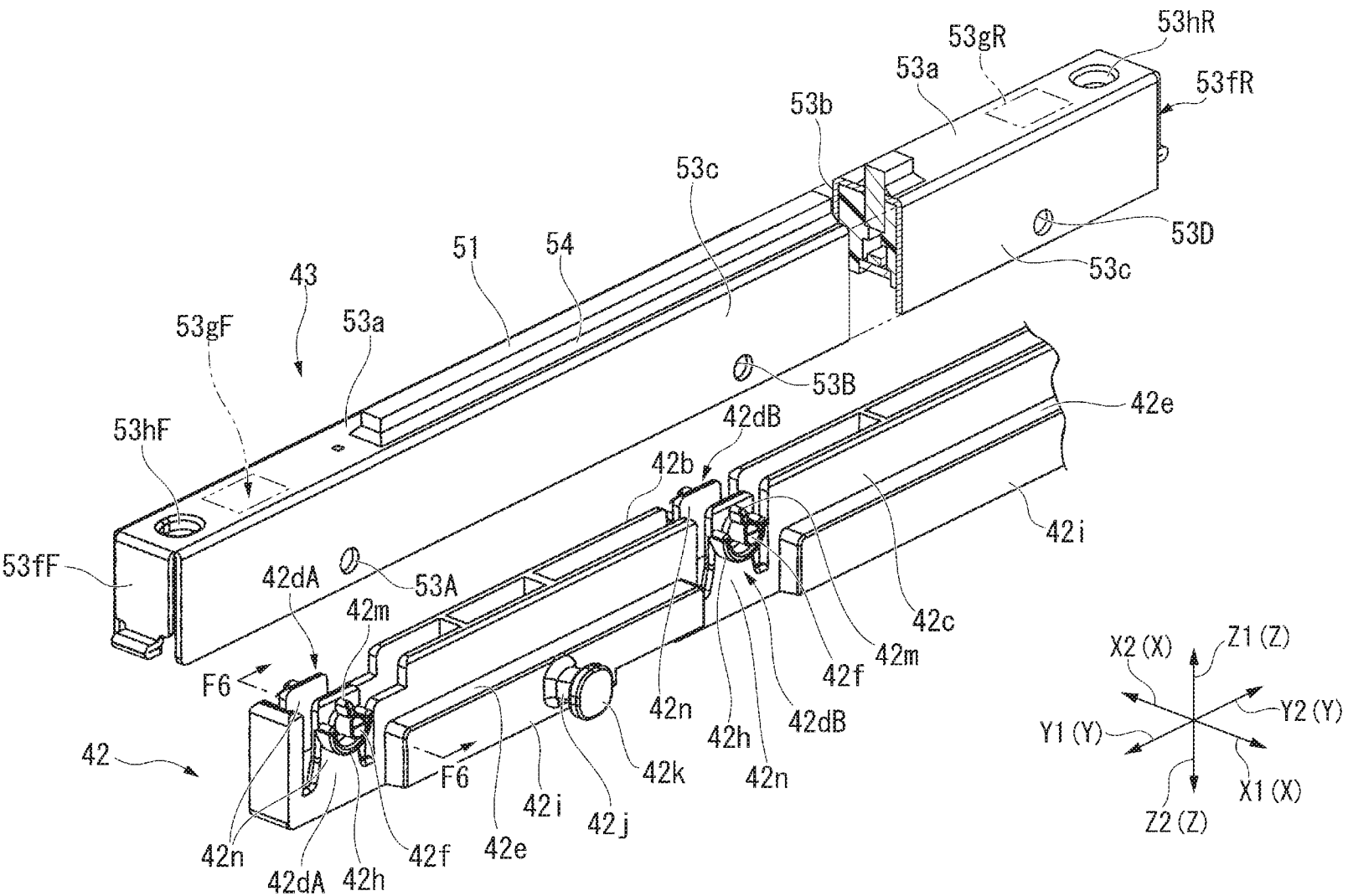
FIG. 5 is a schematic perspective view illustrating the exposure unit and a stay in the image forming apparatus according to the first embodiment.
Figure 6:
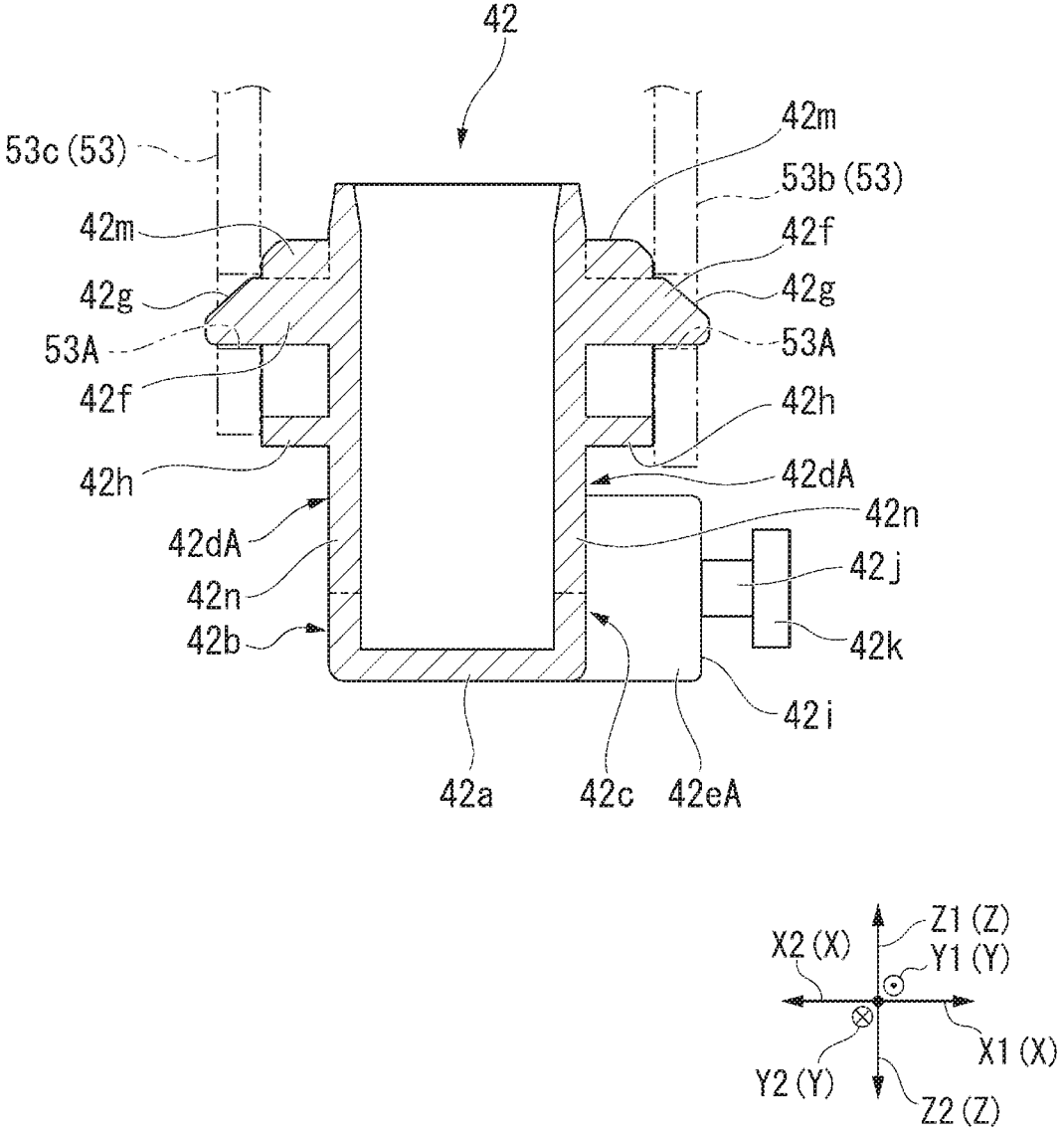
FIG. 6 is a schematic view of a cross section taken along the line F6-F6 in FIG. 5.

Referring now to FIGS. 2-6, a detailed configuration of each exposure unit 26 will be described. The configuration of each exposure unit 26 is common to each other. Hereinafter, the image forming units 25Y, 25M, 25C, and 25K disposed above the exposure unit 26 are referred to as image forming units 25 when not distinguished from each other. FIG. 2 is a schematic side view illustrating the photoconductive body, the exposure unit, and the mechanism in the image forming apparatus of the first embodiment. FIG. 3 is an exploded view of the exposure unit and the mechanism in the image forming apparatus according to the first embodiment. FIG. 4 is a schematic view of a cross section taken along the line F4-F4 in FIG. 3. FIG. 5 is a schematic perspective view illustrating the exposure unit and a stay in the image forming apparatus according to the first embodiment. FIG. 6 is a schematic view of a cross section taken along the line F6-F6 in FIG. 5.

As illustrated in FIG. 2, the image forming unit 25 includes a case 25A that houses (e.g., receives, supports, etc.) at least the photoconductive body 7. The photoconductive body 7 extends longitudinally in the Y direction and includes rotating shafts 7*a* at both ends in the Y direction. Each rotating shaft 7*a* is coaxial with a central axis O parallel to the Y direction. A gear 7*c* is provided at the tip of the rotating shaft 7*a* positioned at an end of the photosensitive body 7 extending in the Y2 direction. A driving force for rotating the photoconductive body 7 is transmitted to the gear 7*c*.

The case 25A includes a bottom plate 25*c*, side plates 25*a*F and 25*a*R, fulcrums 25*f*F and 25*f*R (stoppers, spacers, rests, stop, etc.), and pins 25*e*F and 25*e*R. The bottom plate 25*c* is positioned above the exposure unit 26. The bottom plate 25*c* defines an opening 25*d* through which light emitted by the exposure unit 26 is transmitted to the photosensitive body 7. For example, the opening 25*d* may be a hole or slot that extends through the bottom plate 25*c* in the thickness direction and extends longitudinally in the Y direction. For example, the shape of the opening 25*d* viewed from the Z2 direction may be a rectangular shape. The side plate 25*a*F extends upward from a first end of the bottom plate 25*c* in the Z1 direction. The side plate 25*a*R extends upward from an opposing second end of the bottom plate 25*c* in the Z1 direction is. Each of the side plates 25*a*F and 25*a*R is includes a bearing portion 25*b* (a bearing) that rotatably supports the rotating shaft 7*a* along the central axis O. On the lower surface of the bottom plate 25*c*, the fulcrum 25*f*F and the pin 25*e*F are provided apart from each other in this order in the Y1 direction between the opening 25*d* and the side plate 25*a*F. On the lower surface of the bottom plate 25*c*, the fulcrum 25*f*R and the pin 25*e*R are provided apart from each other in this order in the Y2 direction between the opening 25*d* and the side plate 25*a*R.

The fulcrums 25*f*F and 25*f*R protrude or extends downward from the lower surface of the bottom plate 25*c* in the Z2 direction. The distance between (i) each tip of the fulcrums 25*f*F and 25*f*R in Z2 direction and (ii) the center axis O is equal to each other. The shapes of the fulcrums 25*f*F and 25*f*R are not particularly limited so long as the distance between the exposure unit 26 and the photoconductive body 7 can be kept constant by abutting on an upper plate 53*a* of the exposure unit 26. The form of contact between (i) the tips of the fulcrums 25*f*F and 25*f*R and (ii) the upper plate 53*a* may be any of point contact, line contact, and surface contact. As an example, the fulcrums 25*f*F and 25*f*R may be cylindrical, prismatic, hemispherical, plate-like, or the like. The tips of the fulcrums 25*f*F and 25*f*R may be flat or curved. As another example, the fulcrums 25*f*F and 25*f*R may be quadrangular prisms whose tips are planes parallel to the central axis O.

The pins 25*e*F and 25*e*R protrude or extend downward from the lower surface of the bottom plate 25*c* in the Z2 direction. Each of the pins 25*e*F and 25*e*R may be columnar and have a tapered tip. Each cylindrical portion of the pins 25*e*F and 25*e*R protrudes from the tip of the fulcrums 25*f*F and 25*f*R in the Z2 direction.

As illustrated in FIGS. 2 and 3, the exposure unit 26 includes an exposure device 43, a stay 42, and a mechanism 47 (a repositioning assembly/mechanism or actuator, lift assembly, lift mechanism, etc.). The exposure device 43 includes a light source 50, a lens 51, and a holding member 53 (a light support, a light housing, etc.).

The light source 50 is extends longitudinally in the Y direction. As illustrated in FIG. 4, the light source 50 includes a plurality of light emitting elements 50*a* and a circuit board 50*b*. For example, the plurality of light emitting elements 50*a* are solid state light emitting element arrays. For example, the plurality of light emitting elements 50*a* are arranged in the longitudinal direction of the light source 50. The longitudinal direction of the light source 50 is the Y direction in the image forming apparatus 100. The longitudinal direction, the Y1 direction, and the Y2 direction of the light source 50 in the present embodiment are all examples of the first direction in which the plurality of light emitting elements 50*a* are arranged. For example, the plurality of light emitting elements 50*a* may be an LED array, an organic EL array, or the like. The number of the plurality of light emitting elements 50*a* is equal to or larger than the number of pixels in the main scanning direction in image formation. Each of the plurality of light emitting elements 50*a* emits light L1 according to a drive current supplied by the circuit board 50*b*. The circuit board 50*b* turns the plurality of light emitting elements 50*a* on and off by controlling the drive current for the plurality of light emitting elements 50*a* according to the control signal provided by the control unit 6.

The lens 51 focuses the light L1 and forms light L2 converging in a spot shape at the focal position. The photoconductive body 7 is disposed at or substantially disposed at the focal position of the lens 51 when the mechanism 47 is at an abutment position. The photoconductive body 7 is located at a position separated by a focal distance from the lens 51 when the mechanism 47 is at the abutment position. The mechanism 47 can move the lens 51 to a separated position that is farther than the abutment position. The lens 51 is not particularly limited as long as the light L1 from the plurality of light emitting elements 50*a* can be independently focused. For example, a self-focusing lens array or the like may be used as the lens 51.

The incident angle of an optical axis L of the light L2 on the photoconductive body 7 is not particularly limited. For example, the optical axis L may be inclined with respect to the normal line at the position of incidence on the photoconductive body 7 in order to prevent the light reflected on the surface of the photoconductive body 7 from re-entering the lens 51. The inclination of the optical axis L with respect to the vertical axis is set according to the position of the exposure unit 26 around the photoconductive body 7. For example, the optical axis L may be inclined with respect to the vertical plane.

In the following, the description will be made on the assumption that the optical axis L is along a vertical line as in the example illustrated in FIG. 4. The holding member 53 holds the light source 50 and the lens 51. The material of the holding member 53 may be metal or resin. The holding member 53 may be formed of a composite material of metal and resin. In the example illustrated in FIGS. 3 and 4, the holding member 53 is made of metal. For example, the holding member 53 has a box shape in which a metal plate such as a mild steel plate or a stainless-steel plate is bent.

As illustrated in FIGS. 3 and 4, the holding member 53 includes the upper plate 53*a*, a left plate 53*b*, a right plate 53*c*, a rear plate 53*f*R, and a front plate 53*f*F. The upper plate 53*a* is a flat plate that forms the upper surface of the holding member 53. The shape of the upper plate 53*a* viewed from the Z2 direction is a rectangular shape that is elongated in the Y direction. As illustrated in FIG. 2, the upper plate 53*a* is longer than the length of the body surface of the photoconductive body 7. As illustrated in FIG. 4, an opening 53*d* is formed in the center of the upper plate 53*a* in the X direction. The lens 51 can be inserted through the opening 53*d* in the Z direction.

As illustrated in FIG. 5, a positioning portion 53*h*F (e.g., slot, aperture, hole, etc.) is provided or defined at the end of the upper plate 53*a* in the Y1 direction. The end of the upper plate 53*a* in the Y1 direction means the upper plate 53*a* in a range between the end of the upper plate 53*a* in the Y1 direction and the end of the lens 51. In the example illustrated in FIG. 5, the positioning portion 53*h*F is provided at the end of the upper plate 53*a* in the Y1 direction, in a region near the end of the upper plate 53*a* in the Y1 direction. The positioning portion 53*h*F receives and positions the pin 25*e*F of the image forming unit 25 in the Y direction and the X direction. For example, the positioning portion 53*h*F is a circular hole into which the cylindrical portion of the pin 25*e*F is fitted so as to be able to be inserted and withdrawn.

As illustrated in FIG. 5, a positioning portion 53*h*R is provided or defined at the end of the upper plate 53*a* in the Y2 direction. The end of the upper plate 53*a* in the Y2 direction means the upper plate 53*a* between the end of the upper plate 53*a* in the Y2 direction and the end of the lens 51. In the example illustrated in FIG. 5, the positioning portion 53*h*R is provided at the end of the upper plate 53*a* in the Y2 direction, in a region near the end of the upper plate 53*a* in the Y2 direction. The positioning portion 53*h*R receives and positions the pin 25*e*R of the image forming unit 25 in the X direction. For example, the positioning portion 53*h*R is a hole or slot elongated in the Y direction. The positioning portion 53*h*R has a short width in which the cylindrical portion of the pin 25*e*R can be inserted and removed in the X direction, and a longitudinal width longer than the diameter of the cylindrical portion of the pin 25*e*R.

The positioning portions 53*h*F and 53*h*R are separated from the light source 50 in the Y direction and sandwich the light source 50 therebetween. The positioning portions 53*h*F and 53*h*R position the holding member 53 in the Y direction and the X direction intersecting the Y direction with respect to the fulcrums 25*f*F and 25*f*R by fitting the pins 25*e*F and 25*e*R, respectively.

At the end of the upper plate 53*a* in the Y1 direction, an abutment portion 53*g*F (e.g., an engagement surface, an engagement pad, etc.) on which the tip of the fulcrum 25*f*F engages or abuts is provided next to the positioning portion 53*h*F in the Y2 direction. The shape of the abutment portion 53*g*F is not particularly limited as long as the abutment portion 53*g*F can abut on or engage the fulcrum 25*f*F. For example, the abutment portion 53*g*F may be the surface itself of the upper plate 53*a* or may be a convex portion or a concave portion provided on the upper plate 53*a*. The abutment portion 53*g*F may have a flat surface or a curved surface. In the example illustrated in FIG. 5, the abutment portion 53*g*F is a plane formed by the surface of the upper plate 53*a*.

At the end of the upper plate 53*a* in the Y2 direction, an abutment portion 53*g*R (e.g., an engagement surface, an engagement pad, etc.) on which the tip of the fulcrum 25*f*R engages or abuts is provided next to the positioning portion 53*h*R in the Y1 direction. The shape of the abutment portion 53*g*R is not particularly limited as long as the abutment portion 53*g*R can abut on or engage the fulcrum 25*f*R. For example, the abutment portion 53*g*R may be the surface itself of the upper plate 53*a* or may be a convex portion or a concave portion provided on the upper plate 53*a*. The contact portion 53*g*R may have a flat surface or a curved surface. In the example illustrated in FIG. 5, the abutment portion 53*g*R is a plane formed by the surface of the upper plate 53*a*.

As illustrated in FIGS. 4 and 5, the left plate 53*b* is bent in the Z2 direction from the end of the upper plate 53*a* in the X2 direction and the right plate 53*c* is bent in the Z2 direction from the end of the upper plate 53*a* in the X1 direction. As illustrated in FIG. 3, the outer shape of the left plate 53*b* viewed from the X1 direction is a rectangular shape elongated in the Y direction. The outer shape of the right plate 53*c* viewed from the X1 direction is a rectangular shape elongated in the Y direction similar to the left plate 53*b*, except that the right plate 53*c* is slightly longer in the Z2 direction than the left plate 53*b*.

As illustrated in FIGS. 3 and 5, the rear plate 53*f*R is bent in the Z2 direction from the end of the upper plate 53*a* in the Y2 direction. The length of the rear plate 53*f*R in the Z direction is substantially equal to the length of the left plate 53*b* in the Z direction. The front plate 53*f*F is bent in the Z2 direction from the end of the upper plate 53*a* in the Y1 direction. The length of the front plate 53*f*F in the Z direction is substantially equal to the length of the left plate 53*b* in the Z direction.

As illustrated in FIGS. 3 and 4, near the lower end (the end in the Z2 direction) of the left plate 53*b*, holes 53A, 53B, 53C, and 53D penetrate in the thickness direction. The hole shapes of the holes 53A, 53B, 53C, and 53D are not particularly limited. In the example illustrated in FIG. 3, the holes 53A, 53B, 53C, and 53D are all circular holes having the same diameter. The centers of the holes 53A, 53B, 53C, and 53D are on the same straight line parallel to the upper plate 53*a*. The position of the center of the hole 53A in the Y direction is between the end of the lens 51 in the Y1 direction and the front plate 53*f*F. The distance between the centers of the holes 53A and 53B in the Y direction is d2. The distance between the centers of the holes 53B and 53C is d3, which is longer than d2. For example, d3 is about twice as long as d2. The distance between the centers of the holes 53C and 53D is d4, which is shorter than d3 and similar to d2. In the example illustrated in FIG. 3, d4 is slightly longer than d2.

As illustrated in FIGS. 4 and 5, the holes 53A, 53B, 53C, and 53D penetrate the right plate 53*c* in the same positions as the left plate 53*b* in the thickness direction. As illustrated in an example of the hole 53C in FIG. 4, the holes 53A, 53B, 53C, and 53D of the left plate 53*b* and the right plate 53*c* are coaxial with respect to the axis extending in the X direction, respectively.

The overall shape of the holding member 53 is a box shape in which the left plate 53*b*, the rear plate 53*f*R, the right plate 53*c*, and the front plate 53*f*F extend from the outer edge of the upper plate 53*a*. As illustrated in FIG. 4, at the end of the holding member 53 in the Z2 direction, an opening is formed, which is surrounded by the left plate 53*b*, the rear plate 53*f*R, the right plate 53*c*, and the front plate 53*f*F and opens in the Z2 direction.

As illustrated in FIG. 4, a holder 52 is fixed inside the holding member 53. The material of the holder 52 is not particularly limited. For example, the material of the holder 52 may be any of resin, metal, and/or a composite material of resin and metal. The method of fixing the holder 52 and the holding member 53 is not particularly limited. For example, when the holder 52 is made of resin, the holder 52 may be fixed to the holding member 53 by insert molding. For example, the holder 52 may be fixed to the holding member 53 by bonding, thermal caulking, or the like.

The holder 52 includes an upper holding hole 52*a*, a lower holding hole 52*b*, and a communication hole 52*c*. The upper holding hole 52*a* is formed from the end surface of the holder 52 in the Z1 direction toward the inside/middle thereof. When viewed from the Z2 direction, the upper holding hole 52*a* is formed inside the opening 53*d*. The upper holding hole 52*a* has a size in which the lens 51 can be inserted. When the lens 51 is inserted into the upper holding hole 52*a*, the upper part of the lens 51 protrudes above the upper plate 53*a*. The lens 51 protruding from the upper plate 53*a* is fixed to the upper plate 53*a* via an adhesive portion 54 (adhesive). At the bottom of the upper holding hole 52*a*, an abutting portion 52*d* (e.g., a ledge, a protrusion, etc.), which abuts on or engages the lower end of the lens 51 and positions the lens 51 in the Z direction is provided.

The lower holding hole 52*b* is formed from the end surface of the holder 52 in the Z2 direction toward the inside/middle thereof. The lower holding hole 52*b* has a size in which the light source 50 can be inserted. At the bottom of the lower holding hole 52*b*, an abutting portion 52*e* (e.g., a ledge, a protrusion, etc.) for positioning the plurality of light emitting elements 50*a* in the Z direction is provided. The light source 50 is fixed to the holder 52 with the plurality of light emitting elements 50*a* facing the Z1 direction and the end surface of the circuit board 50*b* in the Z1 direction abutting on or engaging the abutting portion 52*e*. The distance between the abutting portions 52*d* and 52*e* in the Z direction is a distance at which the light emitting positions of the plurality of light emitting elements 50*a* in the Z direction match the back focus of the lens 51. The method of fixing the light source 50 and the holder 52 is not particularly limited. For example, the light source 50 may be fixed to the holder 52 by bonding the circuit board 50*b* and the holder 52. The communication hole 51*c* allows the lower holding hole 52*b* to communicate with the upper holding hole 52*a*. The communication hole 52*c* has a size that allows the light L1 to enter the lens 51.

As illustrated in FIG. 3, the stay 42 is shorter than the holding member 53 in the Y direction and longer than the distance between the holes 53A and 53D. The width of the upper part of the stay 42 in the X direction is a size that allows the stay 42 to be inserted inside the holding member 53. The stay 42 is connected to the holding member 53 with the upper portion of the stay 42 inserted inside the holding member 53. According to an exemplary embodiment, the stay 42 has a lower rigidity than the holding member 53. The stay 42 has bending rigidity lower than that of the holding member 53 at least in bending in the YZ plane. In the present embodiment, the stay 42 is made of resin.

As illustrated in FIG. 3, at the end of the stay 42 in the Z2 direction, a bottom surface portion 42*a* parallel to the XY plane is formed. As illustrated in FIGS. 3 and 5, the stay 42 includes a side surface portion 42*b* in the X2 direction and a side surface portion 42*c* in the X1 direction. Each of the side surfaces 42*b* and 42*c* is a plane parallel to the YZ plane. In the side surface portion 42*b*, plate-like portions 42*d*A, 42 dB, 42*d*C, and 42*d*D having the same shape as each other are formed in the Y direction at the same pitch as the holes 53A, 53B, 53C, and 53D on the left plate 53*b* of the holding member 53. Each of the plate-like portions 42*d*A, 42 dB, 42*d*C, and 42*d*D includes a plate-like protruding piece 42*n* (e.g., a tab) that protrudes from the vicinity of the bottom surface portion 42*a* in the Z1 direction. The surface of each protruding piece 42*n* in the X2 direction is flush with the side surface portion 42*b*. The thickness of each protruding piece 42*n* is smaller than half the thickness of the stay 42 in the X direction. Each protruding piece 42*n* elastically bends in the X direction.

Similarly, in the side surface portion 42*c*, the plate-like portions 42*d*A, 42*d*B, 42*d*C, and 42*d*D having the same shape as each other are formed in the Y direction at the same pitch as the holes 53A, 53B, 53C, and 53D on the right plate 53*c* of the holding member 53 (see FIG. 5, each plate-like portion 42*d*A, and 42*d*B). The plate-like portions 42*d*A, 42*d*B, 42*d*C, and 42*d*D of the side surface portion 42*c* have respective plane-symmetric shapes with respect to a plane parallel to the YZ plane at a position that bisects the distance between the side surface portions 42*b* and 42*c*.

The detailed shape common to each of the plate-like portions 42*d*A, 42*d*B, 42*d*C, and 42*d*D will be described by using an example of the plate-like portion 42*d*A. As illustrated in FIG. 6, each plate-like portion 42*d*A includes a support pin 42*f* and a support protrusion 42*h* (e.g., a first interface). The support pin 42*f* of the plate-like portion 42*d*A in the side surface portion 42*c* fits into the hole 53A in the right plate 53*c* of the holding member 53 (e.g., a second interface). The support pin 42*f* has a cylindrical shape protruding in the X1 direction from the upper surface of the protruding piece 42*n*. The outer diameter of the support pin 42*f* is sized to fit in the hole 53A. At the tip of the support pin 42*f*, an obliquely inclined surface 42*g* that cuts off a part of the cylindrical surface is formed. The height of the inclined surface 42*g* in the Z1 direction increases from the tip to the base end of the support pin 42*f*. The angle of the inclined surface 42*g* with respect to the XY plane is, for example, about 45 degrees. A reinforcing rib 42*m* extending in the X1 direction and the Z1 direction from the protruding piece 42*n* is formed at the uppermost portion of the support pin 42*f*. The tip of the reinforcing rib 42*m* in the X1 direction is separated from the support pin 42*f*. In the support pin 42*f*, between the tip of the reinforcing rib 42*m* and the base end of the inclined surface 42*g*, there is a cylindrical surface that is continuous in the circumferential direction and fits with the hole 53A.

The support protrusion 42*h* of the plate-like portion 42*d*A in the side surface portion 42*c* protrudes from the upper surface of the protrusion 42*n* in the X1 direction. As illustrated in FIG. 5, the shape of the support protrusion 42*h* as viewed in the X2 direction is an arc shape surrounding the lower side and the side of the support pin 42*f*. As illustrated in FIG. 6, the tip of the support protrusion 42*h* in the X1 direction is at the same position as the tip of the reinforcing rib 42*m* in the X1 direction.

The plate-like portion 42*d*A in the side surface portion 42*b* includes the same support pins 42*f*, inclined surfaces 42*g*, reinforcing ribs 42*m*, and support protrusions 42*h* except for being plane-symmetric with the plate portion 42*d*A of the side portion 42*c*. The support pin 42*f* of the plate-like portion 42*d*A in the side surface portion 42*b* fits into the hole 53A of the right plate 53*c*. Similarly, the support pin 42*f* of each plate-like portion 42*d*B fits into each hole 53B, the support pin 42*f* of each plate-like portion 42*d*C fits into each hole 53C, and the support pin 42*f* of each plate-like portion 42*d*D fits into each hole 53D.

As illustrated in FIGS. 4 and 5, a step 42*e*A extending in the Y direction is provided on the side surface 42*c* between the plate-like portions 42*d*A and 42*d*B adjacent to each other in the Y direction. Both ends of the step portion 42*e*A in the Y direction are near the plate portions 42*d*A and 42*d*B, respectively. As illustrated in FIG. 6, the step portion 42*e*A protrudes slightly in the X1 direction from the side surface 42*c* and is positioned adjacent the left plate 53*b* of the holding member 53 (e.g., when the holding member 53 and the stay 42 are engaged). A tip surface 42*i* of the step portion 42*e*A in the X1 direction is a plane parallel to the YZ plane. The upper end of the step portion 42*e*A is lower than the lower end of the left plate 53*b*.

As illustrated in FIGS. 5 and 6, a protrusion 42*j* extending in the X1 direction is provided at an intermediate part in the Y direction and the Z direction on the tip surface 42*i*. For example, the protrusion 42*j* has a rod shape. For example, the protrusion 42*j* may be a column, a polygonal column, or a rod whose both end surfaces in the Z direction are cylindrically rounded. A flange 42*k* having a larger diameter than the protrusion 42*j* is provided at the tip of the protrusion 42*j* in the X1 direction.

As illustrated in FIG. 3, steps 42*e*B and 42*e*C are provided along the side surface 42*c* between the plate-like portions 42*d*B and 42*d*C and between the plate-like portions 42*d*C and 42*d*D, respectively. The steps 42*e*B and 42*e*C have the same shape except that the length in the Y direction differs according to the length in the Y direction of the side surface 42*c* provided with each. The steps 42*e*B and 42*e*C include the same protrusion 42*j* and flange 42*k* as the steps 42*e*A, respectively.

The holding member 53 and the stay 42 are connected to each other by fitting the support pins 42*f* into the holes 53A, 53B, 53C, and 53D. In the exposure unit 26, the stay 42 below the holding member 53 supports the holding member 53 at a plurality of points where the support pins 42*f* and the holes 53A, 53B, 53C, 53D abut in the Z direction. The plurality of points are formed at points where the outer peripheral surface of each support pin 42*f* and the inner peripheral surface of each hole 53A, 53B, 53C, and 53D engage. In the present embodiment, the stay 42 supports the holding member 53 at four points at which the four support pins 42*f* on the side surface portion 42*b* abuts against the holes 53A, 53B, 53C, and 53D and at four points at which the four support pins 42*f* on the side surface portion 42*c* abuts against the holes 53A, 53B, 53C, and 53D. Each of the four points is located between the fulcrums 25*f*R and 25*f*R in the Y direction and is arranged in the Y direction.

The point at which the holding member 53 is supported is formed by engagement of each of the holes 53A, 53B, 53C, and 53D with each of the support pins 42*f*. If the holding member 53 is defined as a first member and the stay 42 is defined as a second member, each of the holes 53A, 53B, 53C, and 53D in the holding member 53 is an example of a concave engaging portion in the first member. Each support pin 42*f* of the stay 42 is an example of a convex second engagement portion that engages with a first engagement portion of the second member.

As illustrated in FIG. 3, the mechanism 47 includes a support member 40, urging members 44F and 44R (e.g., biaser, biasing elements, springs, etc.), a moving body 41, motion conversion mechanisms 41A, 41B and 41C (e.g., slots, guides, etc.), and an operation unit 46 (e.g., lever, arm, etc.).

The support member 40 is a case that accommodates (e.g., receives) the stay 42 and the moving body 41 therein. The support member 40 includes a support portion 40*a* that supports the moving body 41 so as to be able to move forward and backward in the Y direction. For example, the support portion 40*a* may be formed by a plane parallel to the XY plane. For example, the support portion 40*a* may be formed by a protrusion or a ridge located on a plane parallel to the XY plane.

At an end of the support member 40 in the Y1 direction, a mounting portion 40*b* protruding in the Z2 direction from a bottom including the support portion 40*a* is provided. The mounting portion 40*b* is provided with a boss 40*c* for mounting the operation portion 46. The boss 40*c* protrudes in the X2 direction from the side of the mounting portion 40*b*.

The urging members 44F and 44R are provided between the support member 40 and the holding member 53 and urge/bias the holding member 53 in the Z1 direction. In the present embodiment, the Z1 direction is an example of the second direction. The second direction is a direction different from the first direction, in which the holding member 53 is pressed against and abuts on the fulcrums 25*f*F and 25*f*R of the image forming unit 25. The urging members 44F and 44R are not particularly limited as long as the urging members can urge/bias the holding member 53 in the Z1 direction. For example, the urging members 44F and 44R may be or include an elastic spring, an elastic body, or the like. In the example illustrated in FIG. 3, the urging members 44F and 44R are compression coil springs. The lower end of the urging member 44F is disposed at the bottom of the support member 40 in the Y1 direction and extending upward from the support portion 40*a*. The urging member 44F urges/biases the end of the holding member 53 in the Y1 direction from the back surface of the upper plate 53*a*. For example, the urging member 44F may urge/bias the holding member 53 at a position overlapping the abutment portion 53*g*F in the Z direction. The lower end of the biasing member 44R is located at the bottom of the support member 40 in the Y2 direction and extending upward from the support portion 40*a*. The urging member 44R urges/biases the end of the holding member 53 in the Y2 direction from the back surface of the upper plate 53*a*. For example, the urging member 44R may urge/bias the holding member 53 at a position overlapping the abutment portion 53*g*R in the Z direction.

Figure 7:
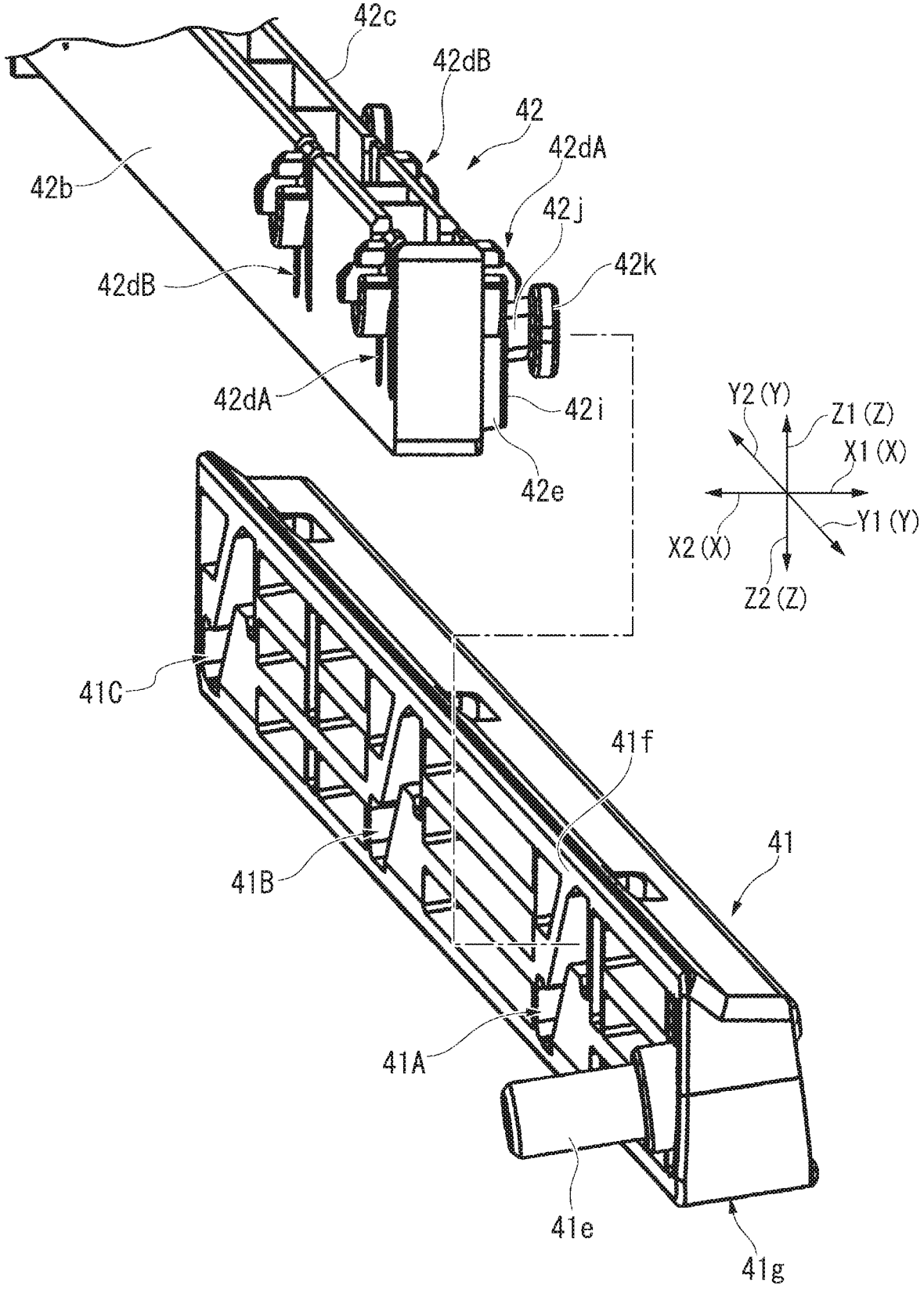
FIG. 7 is a schematic perspective view illustrating the stay and a moving body in the image forming apparatus according to the first embodiment.
Figure 8:
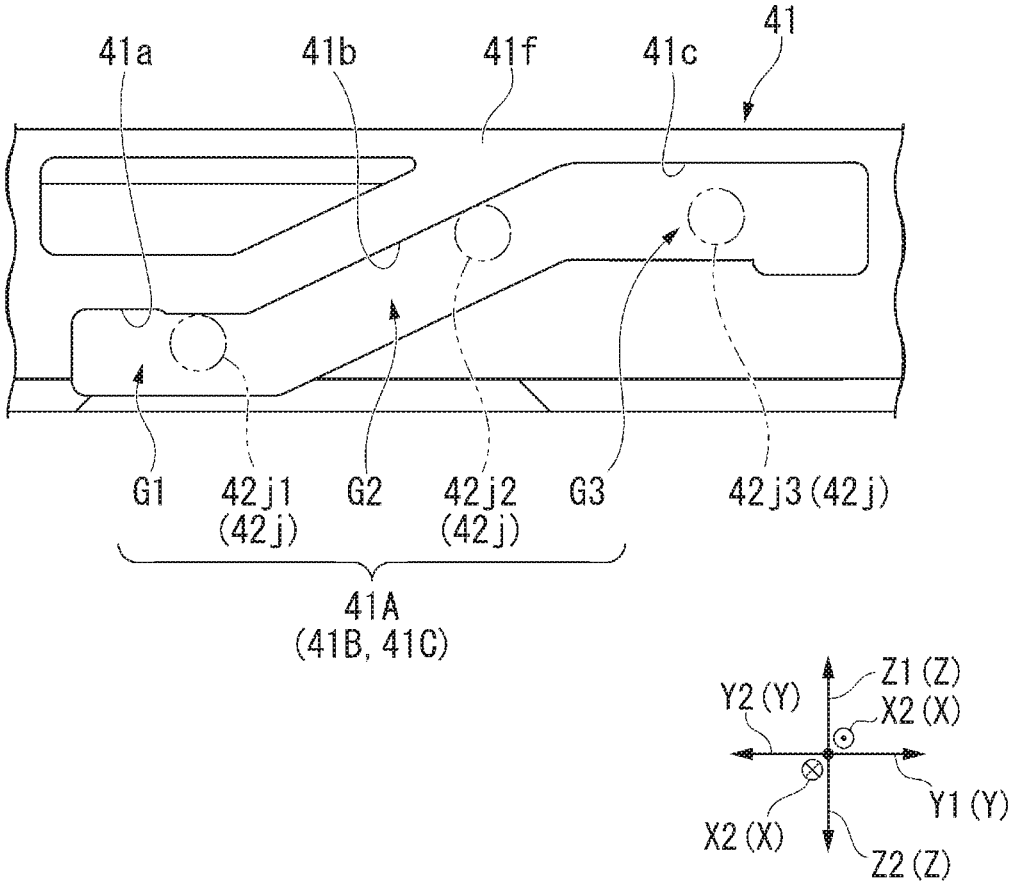
FIG. 8 is a schematic side view illustrating a motion conversion mechanism in the image forming apparatus according to the first embodiment.

The moving body 41 will be described. FIG. 7 is a schematic perspective view illustrating a stay and a moving body in the image forming apparatus according to the first embodiment. FIG. 8 is a schematic side view illustrating a motion conversion mechanism in the image forming apparatus according to the first embodiment.

As illustrated in FIG. 7, the moving body 41 has a thin plate-like shape in the X direction as a whole and extends longitudinally in the Y direction. The moving body 41 is disposed inside the support member 40 next to the stay 42 in the X1 direction. An end surface 41*f* of the moving body 41 in the X2 direction abuts on the tip surface 42*i* of the stay 42. The end surface 41*f* is slidable in the Y and Z directions relative to the tip surface 42*i*. The end surface 41*g* of the moving body 41 in the Z2 direction is slidable in the Y direction with the support portion 40*a*.

At the end of the moving body 41 in the Y1 direction, a boss 41*e* protrudes in the X2 direction from the end surface 41*f* The operation unit 46 is coupled (e.g., attached, secured, etc.) to the boss 41*e*.

The moving body 41 is provided with (e.g., defines, includes, etc.) motion conversion mechanisms 41A, 41B, and 41C. The motion conversion mechanisms 41A, 41B, and 41C convert motion of the moving body 41 in the Y direction into motion in the Z1 direction and transmit the motion to each protrusion 42*j*. In the present embodiment, the motion conversion mechanisms 41A, 41B, and 41C are examples of guide portions that guide the movement of the protrusion 42*j* protruding/extending from the steps 42*e*A, 42*e*B, and 42*e*C, respectively.

The motion conversion mechanism 41A in the present embodiment is a through hole that penetrates from the end surface 41*f* in the X1 direction. The protrusion 42*j* provided on the plate-like portion 42*d*A of the side surface portion 42*c* is inserted into the motion conversion mechanism 41A. As illustrated in FIG. 8, when viewed from the X1 direction, the motion conversion mechanism 41A includes a first guide G1, a second guide G2, and a third guide G3. The opening width of the first guide G1, the second guide G2, and the third guide G3 in the Z direction is wider than the width of the protrusion 42*j* in the Z direction and is smaller than the width of the flange 42*k* in the Z direction.

The first guide G1 is a hole portion extending in the Y1 direction from the end of the motion conversion mechanism 41A in the Y2 direction. The inner surface of the first guide G1 in the Z1 direction is a horizontal guide surface 41*a* that holds the position of the protrusion 42*j* at the lowest position. The horizontal guide surface 41*a* is parallel to the XY plane. The second guide G2 is a hole portion that is inclined toward the Z1 direction as the second guide G2 moves forward in the Y1 direction from the end of the first guide G1 in the Y1 direction. The inner surface of the second guide G2 in the Z1 direction is an inclined guide surface 41*b* that raises the position of the protrusion 42*j*. The third guide G3 is a hole portion extending in the Y1 direction from the end of the second guide G2 in the Y1 direction. The inner surface of the third guide G3 in the Z1 direction is a stopper surface 41*c* that regulates a rising position of the protrusion 42*j*. The stopper surface 41*c* is parallel to the XY plane.

The length of the motion conversion mechanism 41A in the Y direction is longer than the movement stroke of the moving body 41 in the Y direction. For example, when the moving body 41 moves most in the Y1 direction, the protrusion 42*j* faces the horizontal guide surface 41*a* in the Z direction as indicated by a protrusion 42*j*1. For example, when the moving body 41 moves most in the Y2 direction, the protrusion 42*j* faces the stopper surface 41*c* in the Z direction as indicated by a protrusion 42*j*3. For example, when the moving body 41 moves in the middle of the movement stroke, the protrusion 42*j* faces the inclined guide surface 41*b* in the Z direction as indicated by a protrusion 42*j*2.

The motion conversion mechanism 41B is a through hole similar to the motion conversion mechanism 41A, except that the protrusion 42*j* provided on the plate-like portion 42*d*B of the side surface portion 42*c* is inserted therein. The motion conversion mechanism 41C is a through hole similar to the motion conversion mechanism 41A, except that the protrusion 42*j* provided on the plate-like portion 42*d*C of the side surface portion 42*c* is inserted therein. The flange 42*k* provided at the tip of each protrusion 42*f* prevents the protrusion 42*j* inserted in the first guide G1, second guide G2, and third guide G3 from coming off (disengaging) in the X2 direction.

The material of the moving body 41 may be resin or metal. The moving body 41 may be formed of a composite material of resin and metal. In particular, when the motion conversion mechanisms 41A, 41B, and 41C are formed of resin, the periphery of the motion conversion mechanisms 41A, 41B, and 41C is reinforced by an appropriate rib structure or the like so as not to be easily deformed.

The operation unit 46 is configured to facilitate moving the moving body 41 forward or backward in the Y direction with respect to the support member 40. In the example illustrated in FIG. 3, the operation unit 46 is a lever that rotates along the YZ plane. The operation unit 46 includes an elongated lever body 46*b* and a link 46*d* connecting the lever body 46*b* to the moving body 41 (e.g., the boss 41*e* thereof).

A first end of the lever body 46*b* in the length direction is rotatably connected to the tip of the boss 40*c* of the support member 40 via a rotary joint 46*c*. The rotary joint 46*c* supports the lever body 46*b* so as to be rotatable around the central axis of the boss 40*c*. The center axis of the boss 40*c* is parallel to the X direction. A grip portion 46*a* that can be gripped by a user is provided at a second end of the lever body 46*b* opposite to the first end in the length direction. A rotary joint 46*f* connected to the link 46*d* is provided between the first end and the second end in the length direction of the lever body 46*b*.

A first end of the link 46*d* in the length direction is rotatably connected to the lever body 46*b* via the rotary joint 46*f* A second end of the link 46*d* opposite to the first end in the length direction is rotatably connected to the tip of the boss 41*e* of the moving body 41 via a rotary joint 46*e*. The link 46*d* is rotatable relative to the lever body 46*b* about the rotary joint 46*f* with respect to the lever body 46*b* that rotates about the rotary joint 46*c*.

The mechanism 47 is configured to move the holding member 53 up and down with respect to the support member 40 in the Z direction. As illustrated in FIG. 2, when the operation unit 46 stands up and the rotary joint 46*e* is located almost directly above the rotary joint 46*c* (e.g., at a first position), the holding member 53 abuts on the fulcrums 25*f*F and 25*f*R at the abutment portions 53*g*F and 53*f*R. The holding member 53 is at the abutment position. At the abutment position, the focal point of the lens 51 is on the surface of the photoconductive body 7. The holding member 53 presses the fulcrums 25*f*F and 25*f*R in the Z1 direction by the urging forces from the urging members 44F and 44R.

Figure 9:
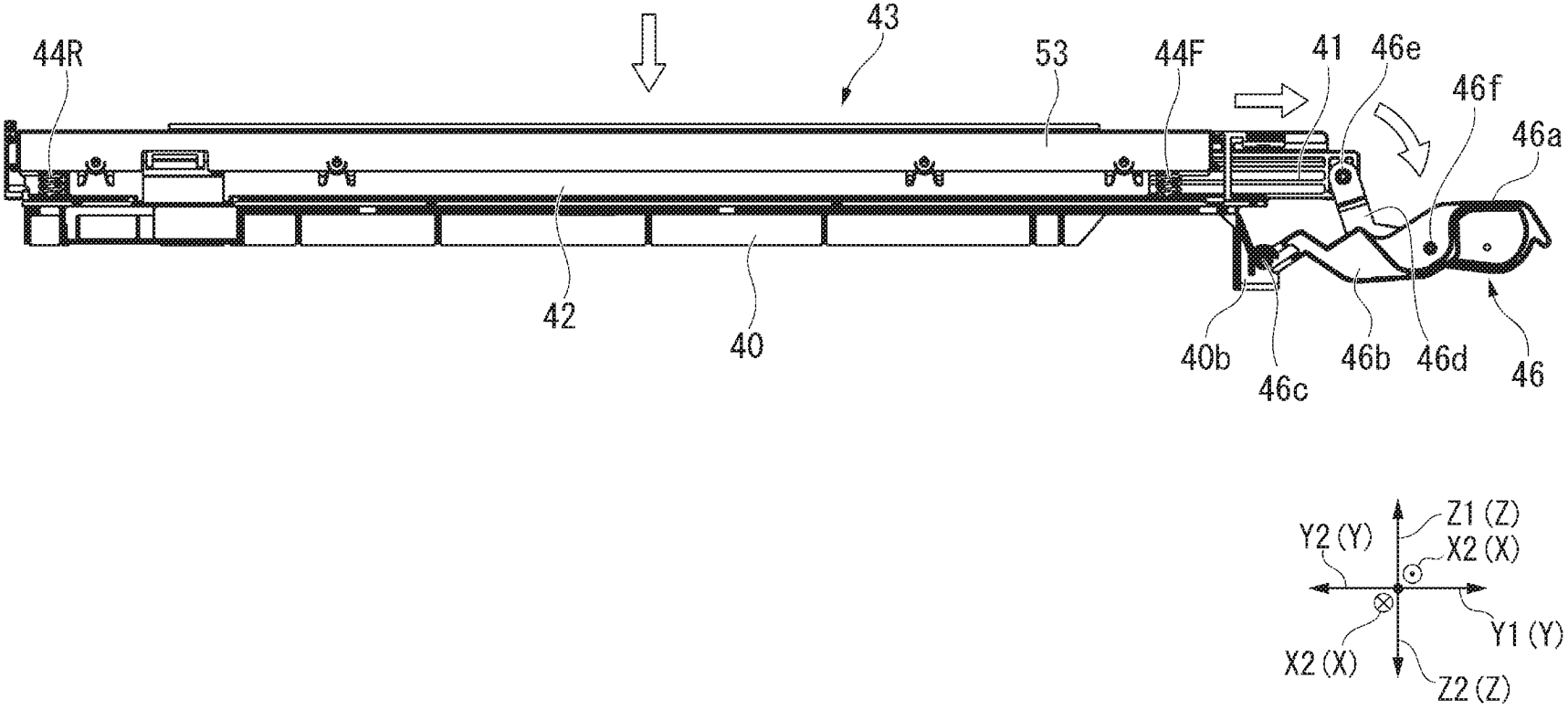
FIG. 9 is a schematic front view illustrating the exposure unit and a mechanism when the image forming apparatus according to the first embodiment is lowered.

FIG. 9 is a schematic front view illustrating an exposure unit and a mechanism at the time of descending in the image forming apparatus of the first embodiment. As illustrated in FIG. 9, when the lever body 46*b* rotates clockwise from the upright state at the abutment position (e.g., the first position), the moving body 41 moves in the Y1 direction. The holding member 53 moves in the Z2 direction together with the stay 42 connected to the moving body 41. The holding member 53 is at the separated position and the lever body 46*b* is at a rotated position (e.g., a second position). At the separated position, the holding member 53 is separated from the fulcrums 25*f*F and 25*f*R by the mechanism 47 against the urging force of the urging members 44F and 44R.

Figure 10A:
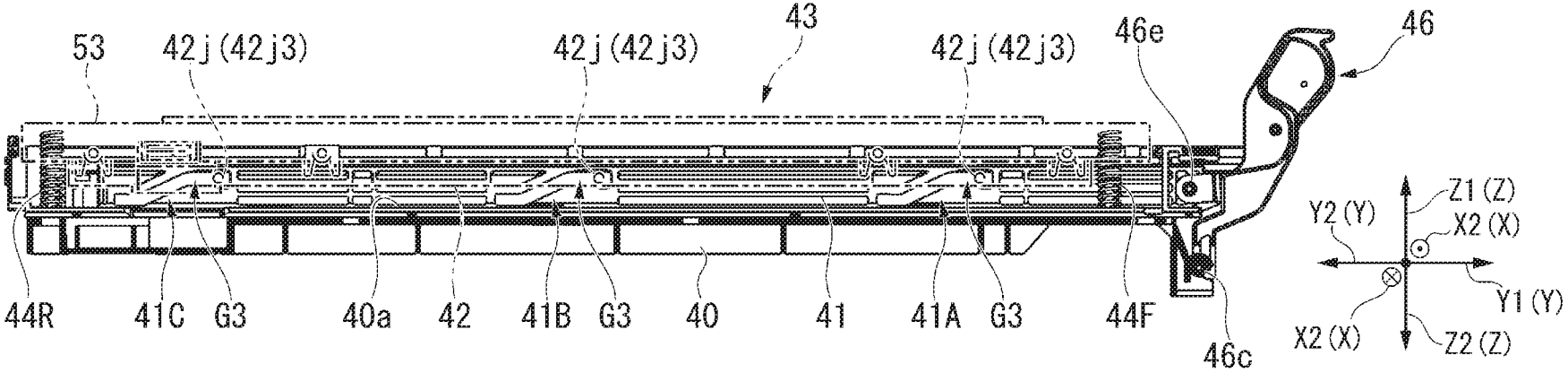
FIGS. 10A and 10B are schematic views illustrating an operation of the mechanism in the image forming apparatus according to the first embodiment.
Figure 10B:
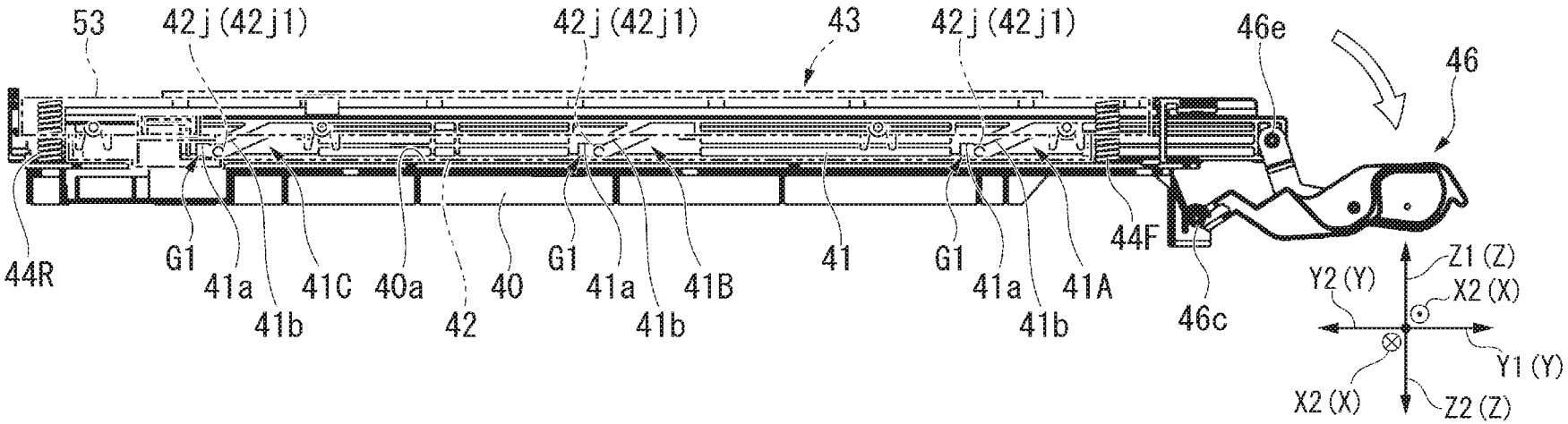
Figure 11A:
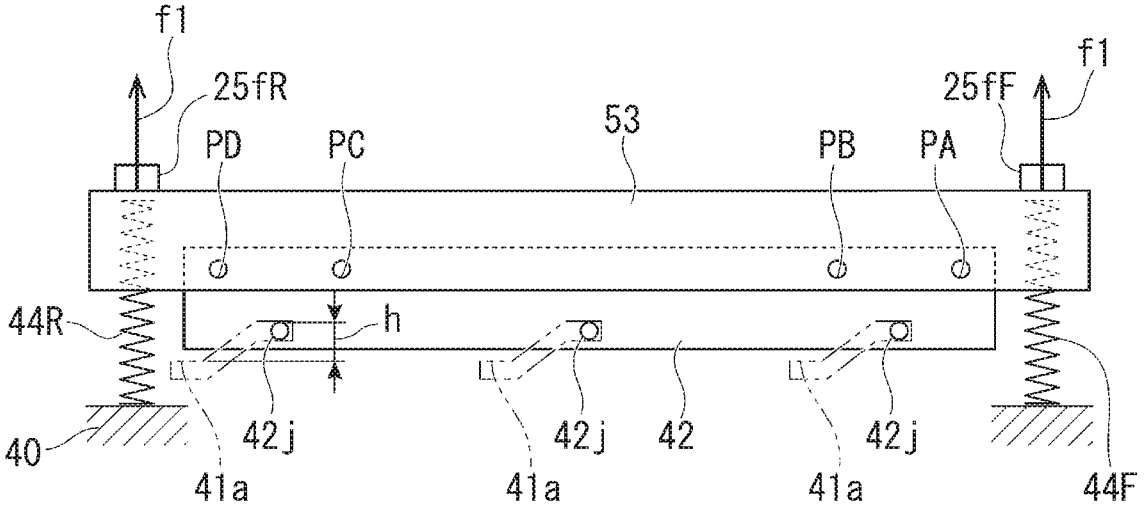
FIGS. 11A and 11B is a schematic view illustrating a force acting on the stay in the image forming apparatus according to the first embodiment.
Figure 11B:
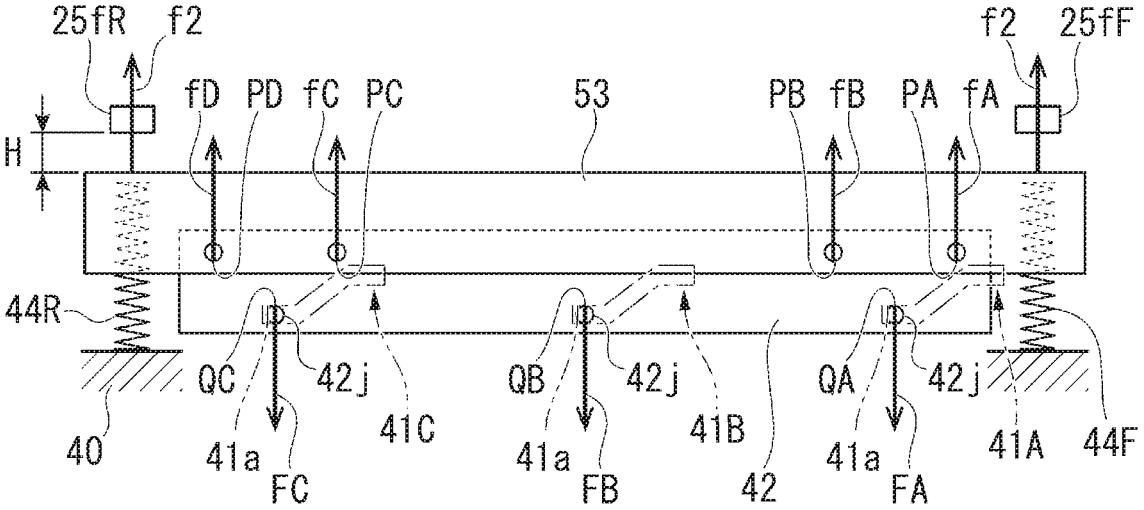

The switching operation between the abutment position and the separated position by the mechanism 47 will be described in detail. FIGS. 10A and 10B are schematic views illustrating the operation of the mechanism 47 in the image forming apparatus 100 according to the first embodiment. FIGS. 11A and 11B are schematic views illustrating a force acting on the stay 42 in the image forming apparatus 100 according to the first embodiment. FIGS. 10A and 11A illustrate the case of the abutment position, and FIGS. 10B and 11B illustrate the case of the separated position.

As illustrated in FIG. 10A, at the abutment position (e.g., a first configuration, an elevated position, first orientation, etc.), the stay 42 is moved in the Y2 direction by the upright operation unit 46. Since the motion conversion mechanisms 41A, 41B, and 41C are also moving in the Y2 direction together with the stay 42, each protrusion 42*j* is located inside the third guide G3 like the protrusion 42*j*3 as illustrated in FIG. 8. Since the third guide G3 is located in the Z1 direction from the horizontal guide surface 41*a*, for example, the upper end of each protrusion 42*j* is located above the horizontal guide surface 41*a* by a distance h (see FIG. 11A).

The holding member 53 is pushed up in the Z1 direction by urging members 44F and 44R that urge the holding member 53 in the Z1 direction with a force f1. The holding member 53 is pressed against the fulcrums 25*f*F and 25*f*R according to the urging forces from the urging members 44F and 44R. Because each protrusion 42*j* does not abut on the third guide G3, the external force from each protrusion 42*j* does not act on the third guide G3. As illustrated in FIG. 11A, the stay 42 is suspended from the holding member 53 at points PA, PB, PC, and PD by its own weight. The points PA, PB, PC, and PD are points at which the respective protrusions 42*f* of the plate portions 42*d*A, 42*d*B, 42*d*C, and 42*d*D abut on the holes 53A, 53B, 53C, and 53D. In the present embodiment, the deformation of the stay 42 itself and the deformation of the holding member 53 due to the weight of the stay 42 can be substantially ignored.

As illustrated in FIG. 10B, at the separated position (e.g., a second configuration, second orientation, a lowered position, etc.), the stay 42 is moved in the Y1 direction by the operation unit 46 which is rotated clockwise in the drawing and turned horizontally. Since the motion conversion mechanisms 41A, 41B, and 41C also move in the Y1 direction along with the stay 42, each protrusion 42*j* abuts on the inclined guide surface 41*b* and is pressed in the Z2 direction by the inclined guide surface 41*b*. Each protrusion 42*j* moves to the first guide G1 lower than the third guide G3 while being guided by the inclined guide surface 41*b*. In the first guide G1, each protrusion 42*j* abuts on the horizontal guide surface 41*a* and is pressed in the Z2 direction by the horizontal guide surface 41*a*. Each protrusion 42*j* abuts on the inclined guide surface 41*b* and the horizontal guide surface 41*a* of the motion conversion mechanisms 41A, 41B, and 41C at operating points QA, QB, and QC, respectively. The stay 42 receives forces FA, FB, and FC in the Z2 direction from the moving body 41 at the operating points QA, QB, and QC, respectively. In the present embodiment, the operating point QA is between the points PA and PB in the Y direction, the operating point QB is between the points PB and PC in the Y direction, and the operating point QC is between the points PC and PD in the Y direction, respectively. The position of the operating point QA between the points PA and PB, the position of the operating point QB between the points PB and PC, and the position of the point QC between the points PC and PD are not particularly limited. For example, in the example illustrated in FIG. 11A, the operating points QB and QC divide distances PAPB, PBPC, and PCPD into two equal parts, respectively.

At the separated position, the holding member 53 is lowered by a distance H from the fulcrums 25*f*F and 25*f*R. Since the urging members 44F and 44R are compressed by H compared to the abutment position, the holding members 53 are pressed with a force f2 (where f2>f1). The stay 42 receives forces fA, fB, fC, and fD in the Z1 direction from the holding member 53 at the points PA, PB, PC, and PD, respectively. The holding member 53 has higher rigidity than the stay 42. Since the deformation of the holding member 53 is smaller than the deformation of the stay 42, the forces fA, fB, fC, and fD are substantially equal to each other. The forces fA, fB, fC, and fD are each approximately one-fourth of 2×f2. Since the weight of the stay 42 is almost negligible, the resultant force of the forces FA, FB, and FC is approximately balanced with the resultant force of the forces fA, fB, fC, and fD.

The stay 42 at the separated position undergoes bending deformation between the points PA and PB due to the force FA acting on the operating point QA. Similarly, bending deformation occurs between the points PB and PC due to the force FB acting on the operating point QB, and bending deformation occurs between the points PC and PD due to the force FC acting on the operating point QC. Since the deflection due to such bending becomes deflection when a concentrated load is applied to approximately the center of the support beam at both ends, for example, the deflection is smaller than that in the case where a load point is easily deformed, such as when a concentrated load acts on the tip of a cantilever support beam. The designed lowering amount h by the motion conversion mechanisms 41A, 41B, and 41C substantially coincides with the lowering amount H of the exposure device 43 held by the holding member 53. A gap substantially matching the design value is formed between the exposure device 43 and the photoconductive body 7 at the separated position. According to the present embodiment, even when the rigidity of the stay 42 is low, the deflection due to bending deformation can be reduced by appropriately setting the span in the Y direction of the two points PA and PB, two points PB and PC, and two points PC and PD sandwiching the operating points QA, QB, and QC, and therefore a gap close to a descending amount h of the protrusion 42*j* can be formed between the photoconductive body 7 and the upper plate 53*a*.

Figure 12:
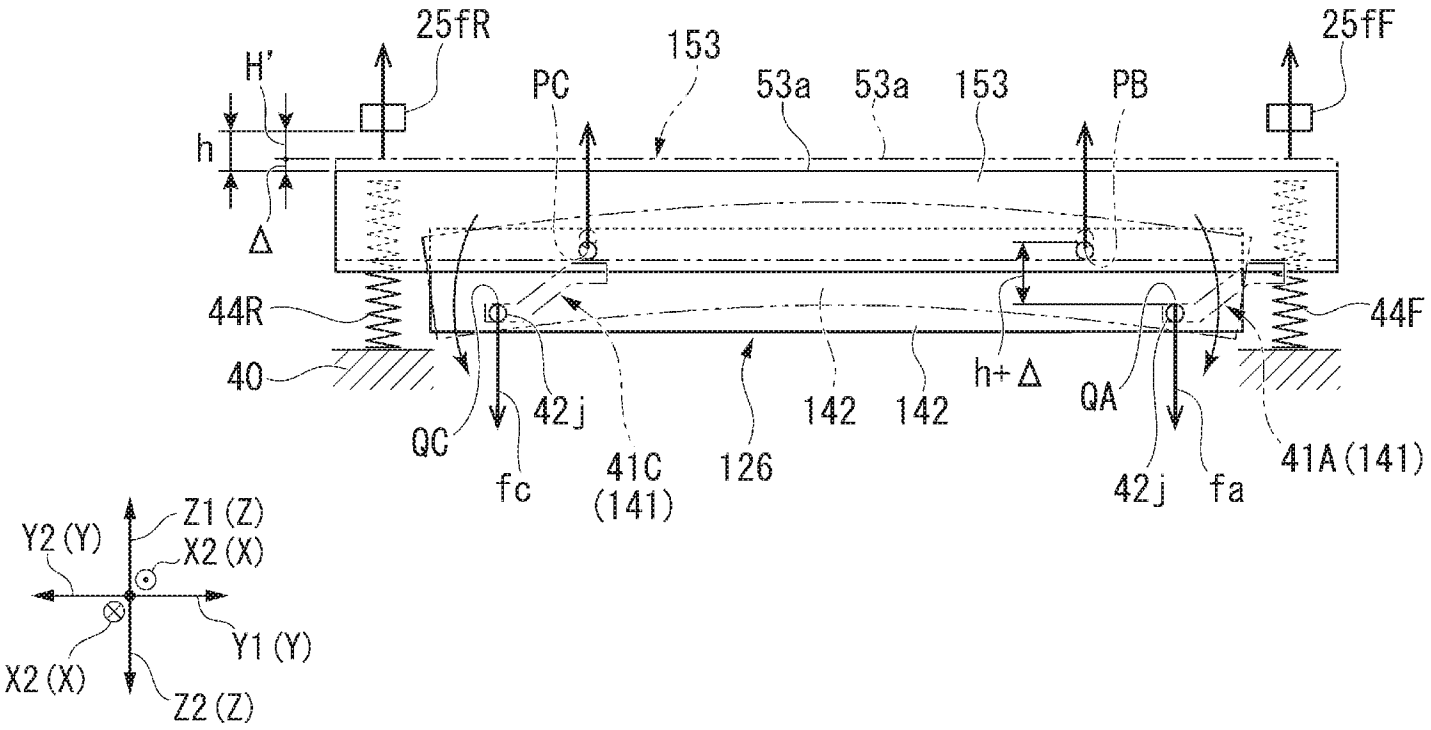
FIG. 12 is a schematic view illustrating a force acting on a stay of an exposure unit in a comparative example.

The operation of the mechanism 47 will be described in comparison with a comparative example. FIG. 12 is a schematic view illustrating a force acting on a stay of an exposure unit in the comparative example. As illustrated in FIG. 12, an exposure unit 126 of the comparative example includes a moving body 141, a stay 142, and a holding member 153 instead of the moving body 41, the stay 42, and the holding member 53 of the exposure unit 26 of the present embodiment. The moving body 141 is the same as the moving body 41 except that the motion conversion mechanism 41B is deleted. The stay 142 and the holding member 153 are the same as the stay 42 and the holding member 53 except that the two points PA and PD and the protrusion 42*j* inserted into the motion conversion mechanism 41B are not included. The stay 142 of the comparative example is supported by the holding member 153 at the two points PB and PC between the urging members 44F and 44R. The stay 142 receives forces fa and fc in the Z2 direction from the horizontal guide surfaces 41*a* of the motion conversion mechanisms 41A and 41C, respectively.

The holding member 153 and the stay 142 indicated by the solid line in FIG. 12 illustrates a state of the separated position when the holding member 153 and the stay 142 can be regarded as a rigid body. The upper plate 53*a* of the holding member 153 is separated from the fulcrums 25*f*F and 25*f*R by a distance h. The distance h is equal to the movement distance in the Z direction until the protrusion 42*j* in the third guide G3 at the abutment position abuts on the horizontal guide surface 41*a*.

The holding member 153 and the stay 142 indicated by the two-dot chain line illustrate the state of the separated position when the holding member 153 is substantially rigid and the stay 142 has lower rigidity than the holding member 153. The stay 142 is supported by the two points PB and PC at the middle part in the longitudinal direction. When the moving body 141 moves in the Y1 direction, the pressing forces fa and fc in the Z2 direction from the operating points QA and QC act, respectively. Since the operating points QA and QB are easily deformed as in the case of the end of the cantilever support beam, the stay 142 warps/deforms in the Z1 direction as a whole. The distance between the operating point QA and the point PB is h+Δ, where Δ is an increment due to the amount of warpage deformation of the stay 142. The same applies to the distance between the operating point QC and the point PC.

Due to the warpage deformation of the stay 142, a descending amount H' of the upper plate 53*a* becomes h−Δ. Since the amount of warpage deformation 4 is larger than the amount of deformation of the stay 42 in the present embodiment in which the operating point is disposed between two points in the Y direction, H' is smaller than the descending amount H of the present embodiment. In the exposure unit 126 of the comparative example, even if the motion conversion mechanisms 41A and 41C have the same shape, the descending amount of the exposure device 43 is small, and therefore a sufficient gap cannot be formed between the photoconductive body 7 and the exposure device 43.

In the comparative example, it is conceivable to increase the descending amount of the motion conversion mechanisms 41A and 41C, but in this case, the height of the moving body 41 increases, and the height of the exposure unit 126 increases, and therefore it is difficult to make the exposure unit 126 compact. In the comparative example, it is also conceivable to make the stay 142 highly rigid, but the component cost of the stay 142 would increase.

The operation of the image forming apparatus 100 will be described. First, the image forming operation of the image forming apparatus 100 will be briefly described. In the image forming apparatus 100 illustrated in FIG. 1, each exposure unit 26 is mounted in the printer unit 3 so that the holding member 53 is at the abutment position. At the abutment position, the focal position of the lens 51 is aligned with the surface of the photoconductive body 7. Image formation is started by operation of the control panel 1 or an external signal. The image information is read by the scanner unit 2 to be copied and sent to the printer unit 3 or sent to the printer unit 3 from an external device. The printer unit 3 sends the sheet S in the sheet feed unit 4 or the sheet S in the manual feed unit 10 to the registration roller 24 based on a control signal generated by the control unit 6 based on an operation of the control panel 1 or an external signal. When an image forming operation is input from the control panel 1, the control unit 6 performs, for example, control to start feeding of the sheet S and image forming.

Each exposure unit 26 exposes each photoconductive body 7 of the image forming units 25Y, 25M, 25C, and 25K based on image information corresponding to each color sent from the control unit 6 and forms an electrostatic latent image corresponding to each image information. Each electrostatic latent image is developed by the developing unit 8, respectively. Therefore, a toner image corresponding to the electrostatic latent image is formed on the surface of each photoconductive body 7. Each toner image is primarily transferred to the intermediate transfer belt 27 by each transfer roller. The toner images are sequentially superimposed with the movement of the intermediate transfer belt 27 without causing color shift and are sent to the transfer unit 28. The sheet S is fed from the registration roller 24 to the transfer unit 28. The toner image that has reached the transfer unit 28 is secondarily transferred to the sheet S. The secondarily transferred toner image is fixed on the sheet S by the fixing unit 29. Thereby, an image is formed on the sheet S.

In the image forming apparatus 100, the image forming unit 25 may need to be pulled out of the apparatus for maintenance. The user tilts the operation unit 46 in the Y1 direction and moves the holding member 53 to the separated position. The holding member 53 is separated downward from the fulcrums 25*f*F and 25*f*R. The exposure device 43 held by the holding member 53 also descends together with the holding member 53. Since a gap is formed above the upper plate 53*a* and above the lens 51 in accordance with the descending amount of the holding member 53, the image forming unit 25 is pulled out in the Y1 direction without interfering with the exposure unit 26. When the maintenance of the image forming unit 25 is completed, the image forming unit 25 is returned to the inside of the printer unit 3, and then the operation unit 46 is erected to move the holding member 53 to the abutment position.

For example, the exposure unit 26 is similarly moved to the separated position when cleaning the lens 51. When cleaning of the lens 51 is completed, for example, by inserting a cleaning tool onto the lens 51 that has been lowered to the separated position, the operation unit 46 is erected to move the holding member 53 to the abutment position.

As described above, according to the image forming apparatus 100 of the present embodiment, since the mechanism 47 is provided, the holding member 53 can be switched between the abutment position and the separated position by the operation of the operation unit 46. Since the operation of the operation unit 46 only switches the rotation position around the rotary joint 46*c*, the operation can be easily performed. The mechanism 47 applies a force in the Z2 direction to the operating points QA, QB, and QC of the stay 42 connected to the holding member 53 at the points PA, PB, PC, and PD, thereby moving the holding member 53 in the Z2 direction. Since each operating point QA, QB, and QC is located between the two points PA and PB, two points PB and PC, and two points PC and PD in the Y direction, the stay 42 is hardly (negligibly) warped and deformed, and the holding member 53 can be lowered to the separated position where a gap with the photoconductive body 7 is secured.

According to the present embodiment, even if a low-rigid material such as resin is used to manufacture the stay 42, since the warpage deformation of the stay 42 at the separated position is suppressed, a gap between the exposure device 43 and the photoconductive body 7 at the separated position can be properly achieved and secured. According to the present embodiment, since such a gap is formed stably, for example, the lens 51 is easily cleanable. Further, the height of the exposure unit 26 can be reduced. When a resin material is used as the material of the stay 42, the motion conversion mechanisms 41A, 41B, and 41C can be integrated with the stay 42, and therefore the weight of the exposure unit 26 and the number of parts can be reduced.

In the present embodiment, in the Z direction, since the urging members 44F and 44R urge the holding member 53 at positions where the urging member 44F overlaps with the abutment portion 53*g*F, and the urging member 44R overlaps with the abutment portion 53*g*R, the urging forces of the urging members 44F and 44R act on substantially the same straight line as the fulcrums 25*f*F and 25*f*R. In this case, the deformation of the holding member 53 due to the urging forces of the urging members 44F and 44R is suppressed.

In the present embodiment, since three operating points QA, QB, and QC separated from each other in the Y direction are provided in the stay 42, also at the point where the force acting on the stay 42 from the moving body 41 is dispersed in the Y direction, the warpage deformation of the stay 42 is easily suppressed. The number of operating points in the stay 42 may be four or more. As the number of operating points increases, warpage deformation of the stay 42 is likely to be suppressed even at a point where the force acting on the stay 42 from the moving body 41 is dispersed in the Y direction.

Second Embodiment

An image forming apparatus according to a second embodiment will be described. As illustrated in FIG. 1, the image forming apparatus 101 according to the present embodiment includes each exposure unit 226 instead of each exposure unit 26 in the first embodiment.

Figure 13:
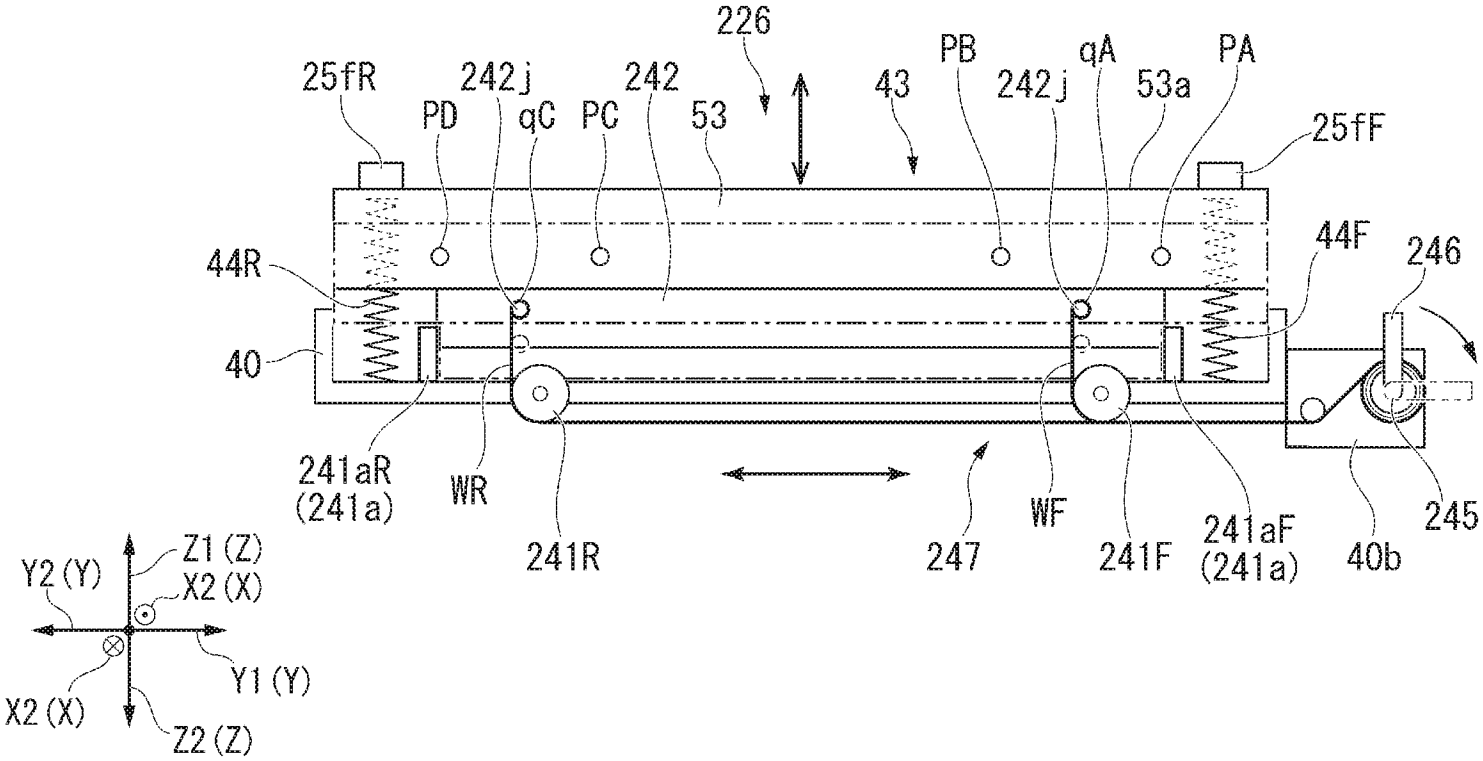
FIG. 13 is a schematic front view illustrating a mechanism in an image forming apparatus according to a second embodiment.

FIG. 13 is a schematic front view illustrating a mechanism in the image forming apparatus 101 according to the second embodiment. As illustrated in FIG. 13, the exposure unit 226 includes a mechanism 247 instead of the mechanism 47 in the first embodiment. The mechanism 247 includes a stay 242, wires WF and WR, a movement guide 241*a*, motion conversion mechanisms 241F and 241R (wheels, pulleys, etc.), a winding roller 245, and an operation unit 246 (e.g., a lever), instead of the stay 42, the moving body 41, and the operation unit 46.

The stay 242 includes a wire fixing portion 242*j* instead of the protrusion 42*j* of the stay 42. The wire fixing portions 242*j* are provided at the same positions as the protrusions 42*j* forming the operating points QA and QC. The configuration of each wire fixing portion 242*j* is not particularly limited as long as the wires WF and WR can be fixed and operating points qA and qC can be formed at the same positions as the operating points QA and QC in the Y direction. For example, the wires WF and WR are stranded wires. The material of the wires WF and WR is not particularly limited as long as the material does not easily expand and contract.

The movement guide 241*a* guides the stay 242 to be able to move up and down in the Z direction. The movement guide 241*a* protrudes from the support portion 40*a* in the Z1 direction. The movement guide 241*a* slidably abuts on the outer peripheral portions of the stay 242 in the Y and X directions. In FIG. 13, the movement guides 241*a*F and 241*a*R for guiding the outer peripheral portion in the Y direction are illustrated.

The motion conversion mechanisms 241F and 241R change the wires WF and WR fixed to the operating points qA and qC and extended in the Z2 direction, respectively, in the Y1 direction. The motion conversion mechanisms 241F and 241R are fixed to the support member 40 below the operating points qA and qC. For example, the motion conversion mechanisms 241F and 241R may include a pulley rotatably supported on the support member 40 in the YZ plane.

The winding roller 245 is rotatably supported in the YZ plane at the mounting portion 40*b*. The winding roller 245 winds up the wires WF and WR directed in the Y1 direction. The operation unit 246 is a lever for rotating the winding roller 245. As illustrated by the solid line in FIG. 13, when the operation unit 246 is upright, the tension of the wires WF and WR is released. As indicated by a two-dot chain line in FIG. 13, when the operation unit 246 is tilted in the Y1 direction from the upright state, the winding roller 245 rotates clockwise in the drawing, and the wires WF and WR are pulled in the Y1 direction.

According to the present embodiment, the holding member 53 is in the abutment position when the operation unit 246 is in the upright position. The traction force from the wires WF and WR does not act on the operating points qA and qC. As in the first embodiment, an urging force acts on the holding member 53 from the urging members 44F and 44R in the Z1 direction. The upper plate 53*a* abuts on the fulcrums 25*f*F and 25*f*R and presses the fulcrums 25*f*F and 25*f*R.

When the operation unit 246 is tilted in the Y1 direction from the upright state, the wires WF and WR fixed to the winding roller 245 are pulled in the Y1 direction. Since the movement directions of the wires WF and WR are changed in the Z direction by the motion conversion mechanisms 241F and 241R, the wires WF and WR fixed to the operating points qA and qC pull the stay 242 in the Z2 direction. The holding member 53 connected to the stay 242 at the points PA, PB, PC, and PD moves in the Z2 direction together with the stay 242 and reaches the separated position. The stay 242 acts on the operating point qA between the points PA and PB in the Y direction and the operating point qC between the points PC and PD with a force in the Z2 direction against the urging force of the urging members 44F and 44R.

According to the present embodiment, the stay 242 does not include an operating point corresponding to the operating point QB, but the operating points qA and qC are sandwiched between the points PA and PB and between the points PC and PD in the Y direction, and therefore the stay 242 can reduce warpage deformation similarly to the first embodiment.

As described above, according to the image forming apparatus 101 of the present embodiment, since the mechanism 247 is provided, the holding member 53 can be switched between the abutment position and the separated position by the operation of the operation unit 246. The mechanism 247 moves the holding member 53 in the Z2 direction by applying a force in the Z2 direction to the operating points qA and qC of the stay 242 connected to the holding member 53 at the points PA, PB, PC, and PD. Since each of the operating points qA and qC is located between the two points PA and PB and the two points PC and PD in the Y direction, the stay 242 is hardly (negligibly) warped and deformed, and the holding member 53 can be lowered to the separated position where a gap with the photoconductive body 7 is achieved and secured.

Hereinafter, a modification example of the above embodiments will be described. In the first embodiment, the description has been given on the assumption that the first member is the holding member 53 and the second member is the stay 42. The concave first engaging portion has been described as each of the holes 53A, 53B, 53C and 53D, and the convex second engaging portion has each of the protrusions 42*f* Rather, the first member and the second member may be opposite. For example, the holding member 53 may be provided with a concave second engagement portion. The second engagement portion may be, for example, a through hole such as the holes 53A, 53B, 53C, and 53D, or may be a non-through hole. For example, the stay 42 may be provided with a convex first engagement portion. The first engagement portion may be, for example, a protrusion such as each protrusion 42*f*. The first engaging portion and the second engaging portion may be detachably engaged with each other as in the embodiment or may be irremovably engaged. Further, after the first engagement portion and the second engagement portion are engaged, the first engagement portion and the second engagement portion may be fixed by, for example, bonding or caulking.

In the first and second embodiments, the holding member 53 at the abutment position has been described as the holding member 53 abutting on the fulcrums 25*f*F and 25*f*R provided on the lower surface of the case 25A. The fulcrums 25*f*F and 25*f*R are separated from the center axis of the bearing portion 25*b* by a certain distance, and therefore the fulcrum 25*f*F and 25*f*R do not abut on the photoconductive body 7 and the relative position with respect to the photoconductive body 7 is fixed. The distance between the holding member 53 and the photoconductive body 7 includes a dimensional error of the fulcrums 25*f*F and 25*f*R, a dimensional error of the case 25A from the bottom plate 25*c* to the side plate 25*a*, and an error due to deformation of the case 25A. For example, the two fulcrums may abut on both the abutment portions 53*g*F and 53*g*R of the holding member 53 and the surface of the photoconductive body 7.

Figure 14:
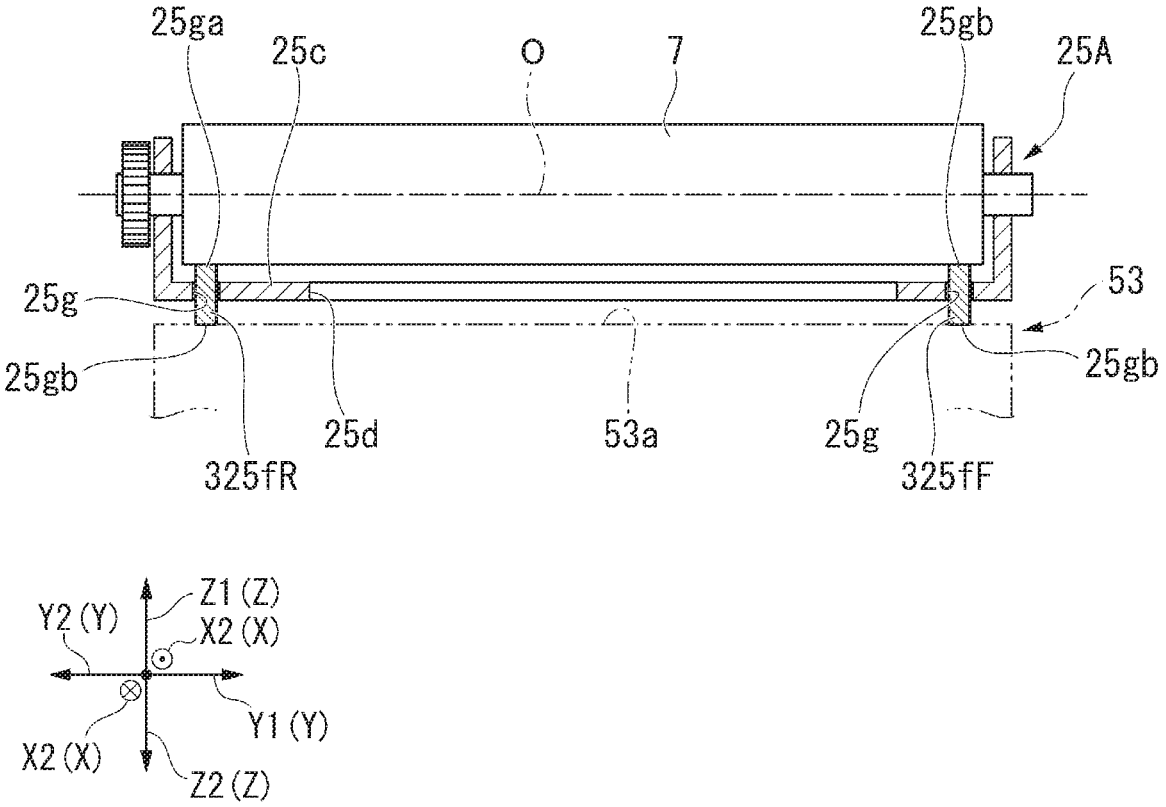
FIG. 14 is a schematic front view illustrating a modification example of two fulcrums in the image forming apparatus of the embodiment.

FIG. 14 is a schematic front view illustrating a modification example of two fulcrums in the image forming apparatus of the embodiment. As illustrated in FIG. 14, in the present modification example, fulcrums 325*f*F and 325*f*R are used instead of the fulcrums 25*f*F and 25*f*R. The fulcrums 325*f*F and 325*f*R are low friction members having good slidable property with the surface of the photoconductive body 7. For example, the fulcrums 325*f*F and 325*f*R are respectively fixed to fixing holes 25*g* penetrating the bottom plate 25*c*. Each upper end 25*ga* of the fulcrums 325*f*F and 325*f*R in the Z1 direction abuts on the surface of the photoconductive body 7. The distances from the central axis O of the photoconductive body 7 to each upper end 25*ga* are equal to each other. Each lower end 25*gb* of the fulcrums 325*f*F and 325*f*R in the Z2 direction protrudes from the bottom plate 25*c* to a position similar to the fulcrums 25*f*F and 25*f*R. The distance in the Z direction between each upper end 25*ga* and each lower end 25*gb* is equal to each other. The shapes of the fulcrums 325*f*F and 325*f*R are not particularly limited. For example, the upper end 25*ga* and the lower end 25*gb* may be an appropriate flat or curved surface that makes point contact, line contact, or surface contact with the photoconductive body 7 and the holding member 53, respectively. For example, the fulcrums 325*f*F and 325*f*R may have uneven portions that can be positioned with respect to the bottom plate 25*c*. The method of fixing the fulcrums 325*f*F and 325*f*R is not limited. For example, the fulcrums 325*f*F and 325*f*R may be fixed to the bottom plate 25*c* by adhesion, fusion, or the like.

According to the present modification, since the distance between the holding member 53 and the photoconductive body 7 at the abutment position is equal to the length of the fulcrums 325*f*F and 325*f*R in the Z direction, even if an error occurs in the distance, the error is in a range of the dimensional error and the deformation amount of each of the fulcrums 325*f*F and 325*f*R. According to the present modification example, since the error factors in the distance between the holding member 53 and the photoconductive body 7 at the abutment position is reduced, the error in the distance between the holding member 53 and the photoconductive body 7 at the abutment position can be reduced. The fulcrums 325*f*F and 325*f*R may be integrally formed with the case 25A by, for example, two-color molding or insert molding. In this case, it is possible to further reduce the disposition error when fixing the case 25A.

In the first embodiment, the description has been given assuming that the optical axis L of the light L2 in the exposure device 43 is along the vertical axis. When the optical axis L is along an axis extending in a ζ direction inclined with respect to the vertical axis, the ζ direction is the second direction. In the description of the exposure device 43, the stay 42, and the mechanism 47, the Z direction corresponding to the second direction may be replaced with the ζ direction.

According to at least one embodiment described above, it is possible to provide an image forming apparatus that can lower a holding member to a separated position where a gap with a photoconductive body is secured by having a stay that supports the holding member at two points arranged in a first direction and has an operating point between the two points in the first direction, and a mechanism that applies a force in a second direction which is a direction different from the first direction, in which the holding member is pressed against and abuts on the two fulcrums, to the operating point to move the holding member in the second direction with respect to the two fulcrums together with the stay.

While certain embodiments have been described, these embodiments have been presented by way of example only, and are not intended to limit the scope of the inventions. Indeed, the novel embodiments described herein may be embodied in a variety of other forms. Furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a photoconductive body;

a light source including a plurality of light emitting elements arranged along a first direction;

a lens positioned to focus light emitted from the plurality of light emitting elements at a focal position;

a light housing configured to hold the light source and the lens;

a first fulcrum;

a second fulcrum spaced from the first fulcrum in the first direction, the light housing being configured to selectively engage the first fulcrum and the second fulcrum, the first fulcrum and the second fulcrum being positioned such that a surface of the photoconductive body is positioned at the focal position when the light housing engages the first fulcrum and the second fulcrum;

a stay positioned to support the light housing at two or more points between the first fulcrum and the second fulcrum; and a repositioning mechanism positioned to apply a force in a second direction that is different than the first direction, the force biasing the light housing in the second direction, the repositioning mechanism including:

a support coupled to the stay;

a biaser positioned between the support and the light housing, the biaser configured to apply the force to the light housing;

a pulley coupled to the support;

a winder;

a wire extending from the stay, around the pulley, and to the winder; and a lever pivotable between (i) a first position to provide a first orientation of the repositioning mechanism and (ii) a second position to wind the wire around the winder to reposition the stay and the light housing to provide a second orientation of the repositioning mechanism;

the light housing being configured to press against the first fulcrum and the second fulcrum when the repositioning mechanism is in the first orientation; and the light housing being spaced from the first fulcrum and the second fulcrum when the repositioning mechanism is in the second orientation.

2. The image forming apparatus of claim 1, wherein the repositioning mechanism includes a plurality of pulleys and a plurality of wires.

3. The image forming apparatus of claim 1, wherein the stay has lower rigidity than the light housing.

4. The image forming apparatus of claim 1, wherein the light housing includes or defines a pair of engagement pads disposed along an upper surface of the light housing, the pair of engagement pads positioned to engage the first fulcrum and the second fulcrum.

5. The image forming apparatus of claim 4, wherein the pair of engagement pads are at least one of flat, convex, or concave.

6. The image forming apparatus of claim 1, wherein the stay supports the light housing at three or more points between the first fulcrum and the second fulcrum.

7. The image forming apparatus of claim 1, further comprising a case configured to hold the photoconductive body, the case defining a slot that permits the light emitted from the plurality of light emitting elements to travel into the case and interact with the photoconductive body.

8. The image forming apparatus of claim 7, wherein the case includes (i) a first pin positioned proximate a first end of the case and extending from the case and (ii) a second pin positioned proximate an opposing second end of the case and extending from the case, wherein an upper surface of the light housing defines (i) a first aperture positioned proximate a first end of the light housing and (ii) a second aperture positioned proximate an opposing second end of the light housing, and wherein the first pin and the second pin selectively engage the first aperture and the second aperture, respectively, when the repositioning mechanism is in the first orientation.

9. The image forming apparatus of claim 8, wherein the first aperture is a round hole and the second aperture is an elongated hole.

10. The image forming apparatus of claim 7, wherein the first fulcrum and the second fulcrum are disposed along an exterior of the case and positioned adjacent the slot.

11. The image forming apparatus of claim 7, wherein the first fulcrum and the second fulcrum extend through the case, engage the photoconductive body, and are positioned adjacent the slot.

12. The image forming apparatus of claim 1, wherein the stay defines a first plurality of interfaces and the light housing defines a second plurality of interfaces, the first plurality of interfaces positioned to engage with the second plurality of interfaces to support the light housing at the two or more points.

13. The image forming apparatus of claim 12, wherein each of the first plurality of interfaces includes a protrusion and each of the second plurality of interfaces includes a recess or hole that receives the protrusion, or wherein each of the first plurality of interfaces includes the recess or hole and each of the second plurality of interfaces includes the protrusion.

* * * * *